US009959880B2

(12) United States Patent
Peters et al.

(10) Patent No.: US 9,959,880 B2
(45) Date of Patent: May 1, 2018

(54) CODING HIGHER-ORDER AMBISONIC COEFFICIENTS DURING MULTIPLE TRANSITIONS

(71) Applicant: QUALCOMM Incorporated, San Diego, CA (US)

(72) Inventors: Nils Günther Peters, San Diego, CA (US); Dipanjan Sen, San Diego, CA (US); Moo Young Kim, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days. days.

(21) Appl. No.: 15/290,229

(22) Filed: Oct. 11, 2016

(65) Prior Publication Data

US 2017/0110140 A1 Apr. 20, 2017

Related U.S. Application Data

(60) Provisional application No. 62/241,665, filed on Oct. 14, 2015.

(51) Int. Cl.
*H04R 5/02* (2006.01)
*G10L 19/20* (2013.01)
(Continued)

(52) U.S. Cl.
CPC ..... *G10L 19/20* (2013.01); *G10L 19/008* (2013.01); *G10L 19/167* (2013.01); *H04S 3/02* (2013.01);
(Continued)

(58) Field of Classification Search
CPC ..... G10L 19/20; G10L 19/008; G10L 19/167; H04S 3/02; H04S 5/00; H04S 2400/01; H04S 2420/11; H04R 2499/15
(Continued)

(56) References Cited

U.S. PATENT DOCUMENTS

2011/0249821 A1 10/2011 Jaillet et al.
2012/0155653 A1* 6/2012 Jax ..... H04H 20/89 381/22
(Continued)

FOREIGN PATENT DOCUMENTS

WO 2014194099 A1 12/2014

OTHER PUBLICATIONS

International Search Report and Written Opinion from International Application No. PCT/US2016/056625, dated Dec. 22, 2016, 11 pp.
(Continued)

*Primary Examiner* — William A Jerez Lora
(74) *Attorney, Agent, or Firm* — Shumaker & Sieffert, P.A.

(57) ABSTRACT

In general, techniques are described for coding higher-order ambisonic coefficients during multiple transitions. A device comprising a processor and a memory coupled to the processor may be configured to perform the techniques. The processor may be configured to obtain a multi-transition indication of whether an ambient HOA coefficient is in transition during a same frame of the bitstream as a foreground audio signal is in transition. The processor may also be configured to obtain a vector that describes a spatial characteristic of a corresponding foreground audio signal based on the multi-transition indication, both the vector and the corresponding HOA audio signal decomposed from the HOA audio data. The memory may be configured to store the vector.

51 Claims, 10 Drawing Sheets

(51) Int. Cl.

| | |
|---|---|
| ***G10L 19/16*** | (2013.01) |
| ***H04S 5/00*** | (2006.01) |
| ***G10L 19/008*** | (2013.01) |
| ***H04S 3/02*** | (2006.01) |

(52) U.S. Cl.
CPC ..... *H04S 5/00* (2013.01); *H04R 2499/15* (2013.01); *H04S 2400/01* (2013.01); *H04S 2420/11* (2013.01)

(58) Field of Classification Search
USPC ..... 381/22, 23, 306
See application file for complete search history.

(56) References Cited

U.S. PATENT DOCUMENTS

| | | | | |
|---|---|---|---|---|
| 2014/0111662 | A1* | 4/2014 | Mashiah | G06T 13/80 348/220.1 |
| 2015/0213803 | A1 | 7/2015 | Peters et al. | |
| 2015/0213809 | A1 | 7/2015 | Peters et al. | |
| 2017/0110140 | A1* | 4/2017 | Peters | G10L 19/20 |

OTHER PUBLICATIONS

"Call for Proposals for 3D Audio," ISO/IEC JTC1/SC29/WG11/N13411, Jan. 2013, 20 pp.
Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.
Poletti, "Three-Dimensional Surround Sound Systems Based on Spherical Harmonics," J. Audio Eng. Soc., vol. 53, No. 11, Nov. 2005, pp. 1004-1025.
"Information Technology—High Efficiency Coding and Media Delivery in Heterogeneous Environments—Part 3: Part 3: 3D Audio, Amendment 3: MPEG-H 3D Audio Phase 2," ISO/IEC JTC 1/SC 29N, Jul. 25, 2015, 208 pp.
"Information Technology—High Efficiency Coding and Media Delivery in Heterogeneous Environments—Part 3: 3D Audio," ISO/IEC JTC 1/SC 29 N, ISO/IEC CD 2300-8, Apr. 4, 2014, 337 pp.
"Information Technology—High Efficiency Coding and Media Delivery in Heterogeneous Environments—Part 3: 3D Audio," ISO/IEC JTC 1/SC 29, ISO/IEC DIS 23008-3, Jul. 25, 2014, 311 pp.
"Information technology—Dynamic Adaptive Streaming over HTTP (DASH)—Part 1: Media Presentation Description and Segment Formats," ISO/IEC 23009-1, International Standard, Apr. 1, 2012, 132 pp.
Paila, et al., "FLUTE—File Delivery over Unidirectional Transport," Internet Engineering Task Force, RFC 6726, Nov. 2012, 46 pp.
U.S. Appl. No. 14/594,533, filed Jan. 12, 2015 and entitled "Transitioning of Ambient Higher-Order Ambisonic Coefficients."
U.S. Appl. No. 14/609,208, filed Jan. 29, 2015 and entitled "Coding Independent Frames of Ambient Higher-Order Ambisonic Coefficients."
Sen et al., "RM1-HOA Working Draft Text ", MPEG Meeting; Jan. 2014; San Jose; (Motion Picture Expert Group or ISO/IEC JTC1/SC29/WG11), No. m31827, XP030060280, 83 pp.
Hollerweger, et al., "An Introduction to Higher Order Ambisonic," Oct. 2008, 13 pp.
Sen et al., "Technical Description of the Qualcomm's HOA Coding Technology for Phase II," ISO/IEC JTC/SC29/WG11 MPEG 2014/M34104, Jul. 2014, 4 pp.
Schonefeld, "Spherical Harmonics," Jul. 1, 2005, XP002599101, 25 pp., Accessed online [Jul. 9, 2013] at URL: http://videoarch1.s-inf.de/~volker/prosem_paper.pdf.
Chapter II Demand and Response to Written Opinion from International Application No. PCT/US2016/056625, dated Aug. 9, 2017, 28 pp.
Second Written Opinion from International Application No. PCT/US2016/056625, dated Aug. 31, 2017, 6 pp.
International Preliminary Report on Patentability from International Application No. PCT/US2016/056625, dated Dec. 1, 2017, 21 pp.

* cited by examiner

CODING HIGHER-ORDER AMBISONIC COEFFICIENTS DURING MULTIPLE TRANSITIONS

This application claims the benefit of U.S. Provisional Application No. 62/241,665, entitled "CODING HIGHER-ORDER AMBISONIC COEFFICIENTS DURING MULTIPLE TRANSITIONS," and filed 14 Oct. 2015, the entire contents of which are incorporated herein by reference.

TECHNICAL FIELD

This disclosure relates to audio data and, more specifically, compression of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for compression of higher-order ambisonics audio data. Higher-order ambisonics audio data may comprise at least one spherical harmonic coefficient corresponding to a spherical harmonic basis function having an order greater than one.

In one aspect, a device configured to decode a bitstream representative of higher-order ambisonic (HOA) audio data, the device comprises one or more processors configured to obtain a multi-transition indication of whether an ambient HOA coefficient is in transition during a same frame of the bitstream as a foreground audio signal is in transition, and obtain a vector that describes a spatial characteristic of a corresponding foreground audio signal based on the multi-transition indication, both the vector and the corresponding foreground audio signal having been decomposed from the HOA audio data. The device also comprising a memory coupled to the one or more processors, and configured to store the vector.

In another aspect, a method of decoding a bitstream representative of higher-order ambisonic (HOA) audio data, the method comprises obtaining a multi-transition indication of whether an ambient HOA coefficient is in transition during a same frame of the bitstream as a foreground audio signal is in transition, and obtaining a vector that describes a spatial characteristic of a corresponding foreground audio signal based on the multi-transition indication, both the vector and the corresponding foreground audio signal having been decomposed from the HOA audio data.

In another aspect, a non-transitory computer-readable storage medium has stored thereon instructions that, when executed, cause one or more processors to obtain a multi-transition indication of whether an ambient HOA coefficient is in transition during a same frame of the bitstream as a foreground audio signal is in transition, and obtain a vector that describes a spatial characteristic of a corresponding foreground audio signal based on the multi-transition indication, both the vector and the corresponding foreground audio signal having been decomposed from the HOA audio data.

In another aspect, a device for decoding a bitstream representative of higher-order ambisonic (HOA) audio data, the device comprises means for obtaining a multi-transition indication of whether an ambient HOA coefficient is in transition during a same frame of the bitstream as a foreground audio signal is in transition, and means for obtaining a vector that describes a spatial characteristic of a corresponding foreground audio signal based on the multi-transition indication, both the vector and the corresponding foreground audio signal having been decomposed from the HOA audio data.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
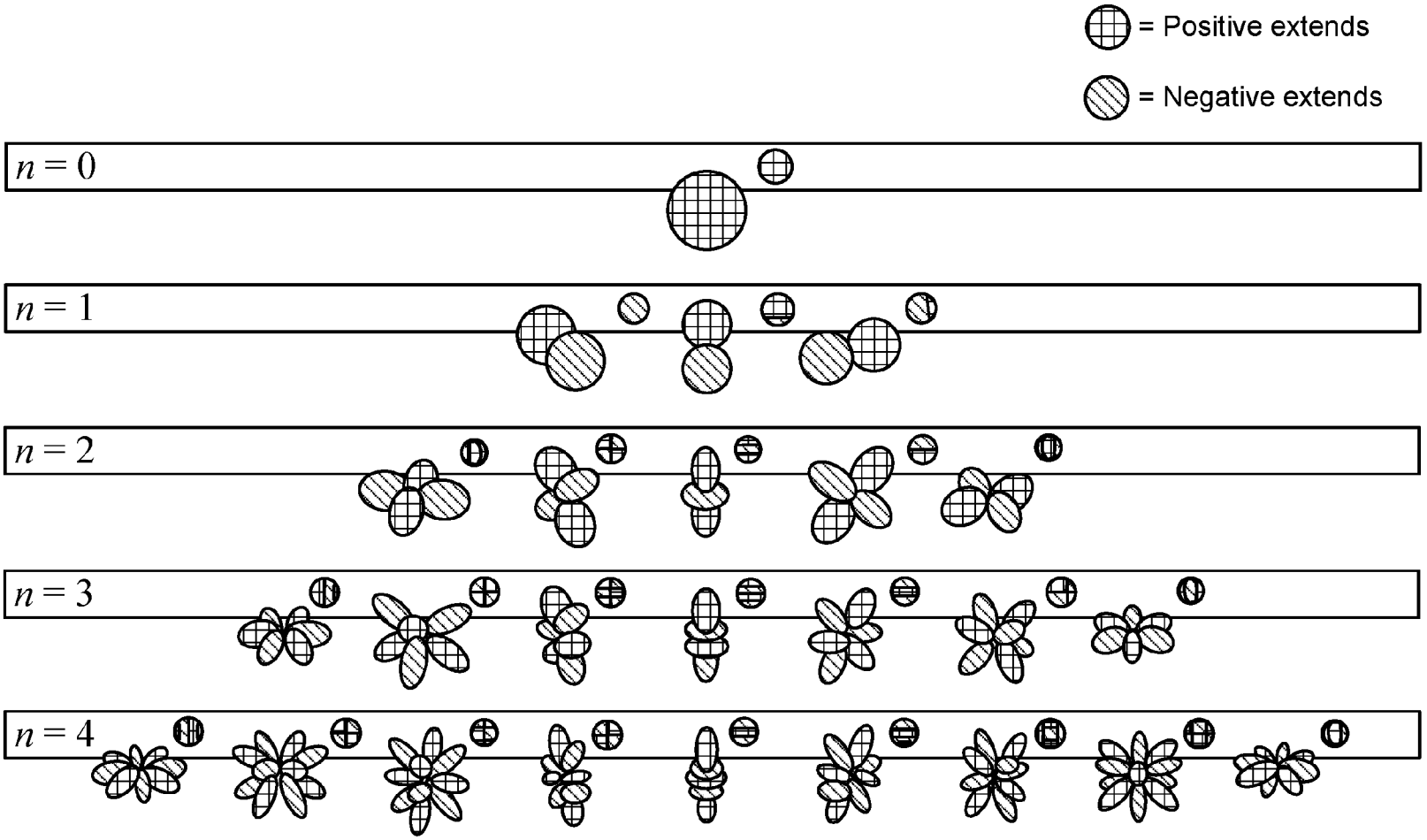
FIG. 1 is a diagram illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\bullet)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$. The remaining figures are described below in the context of object-based and SHC-based audio coding.

Figure 2:
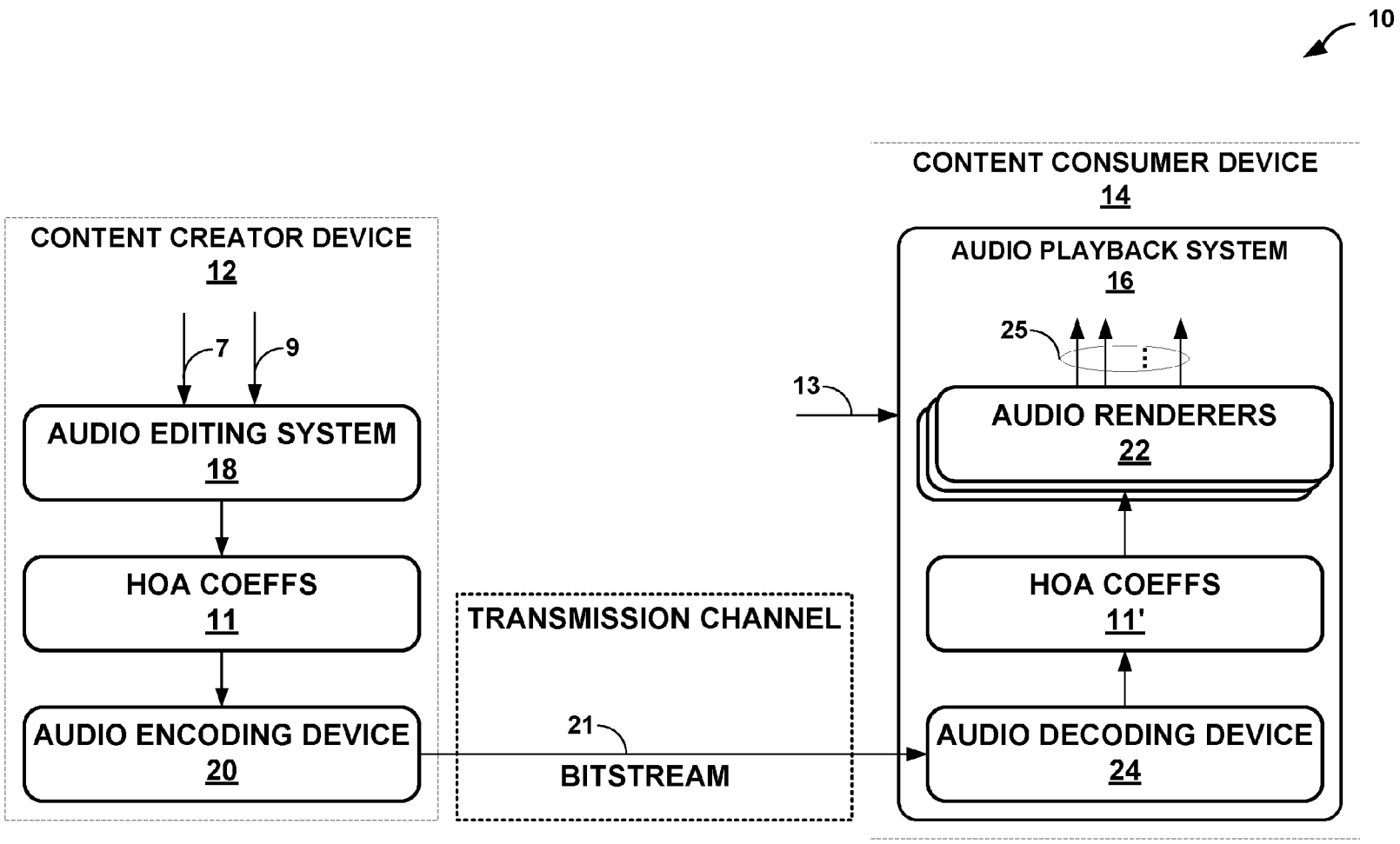
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data.

Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, a television (including so-called "smart televisions"), a receiver (such as an audio/visual—AV—receiver), a media player (such as a digital video disc player, a streaming media player, etc.), or a desktop computer to provide a few examples.

When the content consumer device 14 represents a television, the content consumer device 14 may include integrated loudspeakers. In this instance, the content consumer device 14 may render the reconstructed HOA coefficients to generate loudspeaker feeds and output the loudspeaker feeds to drive the integrated loudspeakers.

When the content consumer device 14 represents a receiver or a media player, the content consumer device 14 may couple (either electrically or wirelessly) to the loudspeakers. The content consumer device 14 may, in this instance, render the reconstructed HOA coefficients to generate the loudspeaker feeds, and output the loudspeaker feeds to drive the loudspeakers.

The content creator device 12 may be operated by a movie studio or other entity that may generate multi-channel audio content for consumption by operators of a content consumers, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes an audio editing system 18. The content creator device 12 obtain live recordings 7 in various formats (including directly as HOA coefficients) and audio objects 9, which the content creator device 12 may edit using audio editing system 18. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel.

The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (loudspeaker geometry wise) to that specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers 3 may then playback the rendered loudspeaker feeds 25.

Figure 3:
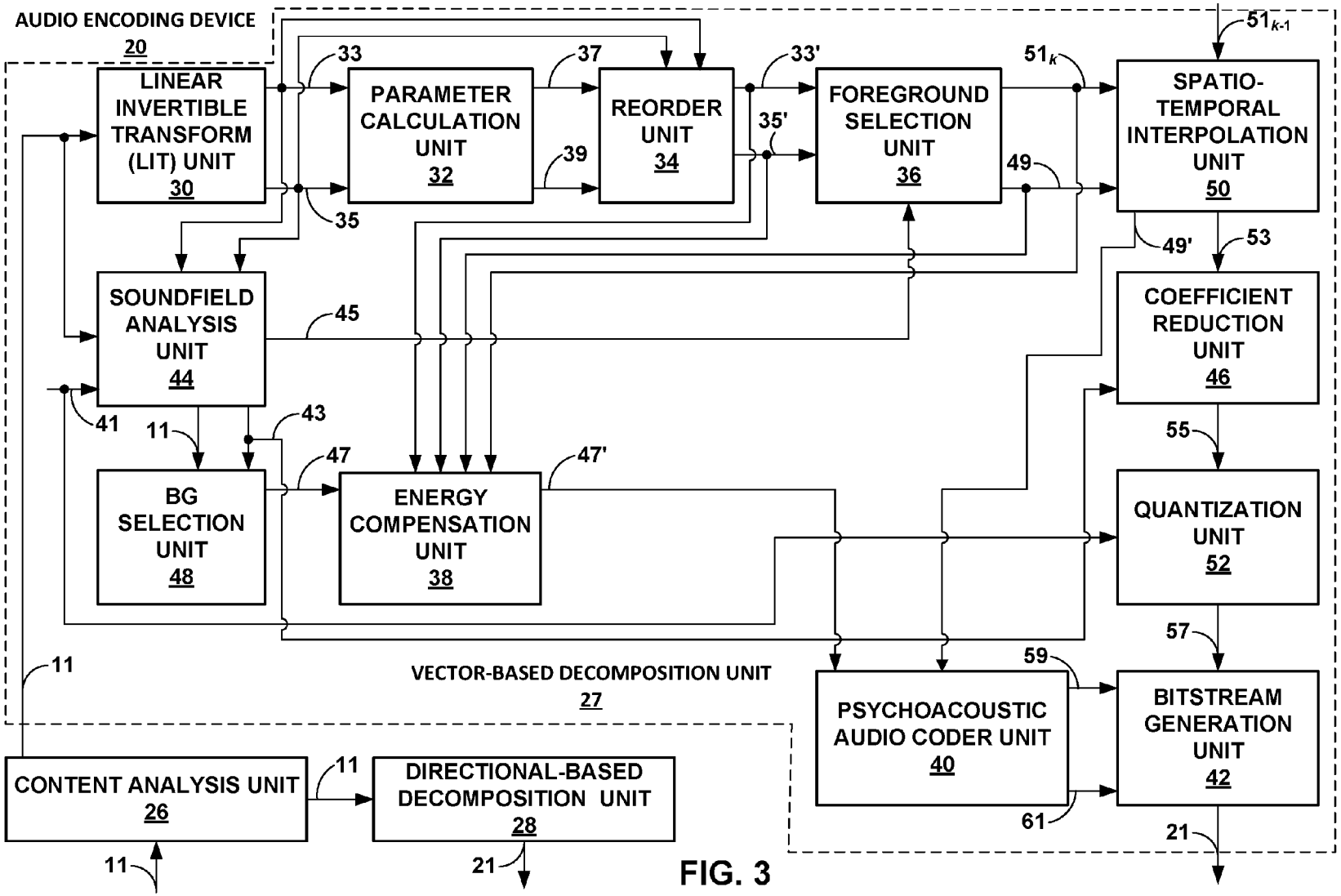
FIG. 3 is a block diagram illustrating, in more detail, one example of the audio encoding device shown in the example of FIG. 2 that may perform various aspects of the techniques described in this disclosure.

FIG. 3 is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based decomposition unit 27 and a directional-based decomposition unit 28.

Although described briefly below, more information regarding the vector-based decomposition unit 27 and the various aspects of compressing HOA coefficients is available in International Patent Application Publication No. WO 2014/194099, entitled "INTERPOLATION FOR DECOMPOSED REPRESENTATIONS OF A SOUND FIELD," filed 29 May 2014. In addition, more details of various aspects of the compression of the HOA coefficients in accordance with the MPEG-H 3D audio standard, including a discussion of the vector-based decomposition summarized below, can be found in:

- ISO/IEC DIS 23008-3 document, entitled "Information technology—High efficiency coding and media delivery in heterogeneous environments—Part 3: 3D audio," by ISO/IEC JTC 1/SC 29/WG 11, dated 2014 Jul. 25 (available at: http://mpeg.chiariglione.org/standards/mpeg-h/3d-audio/dis-mpeg-h-3d-audio, hereinafter referred to as "phase I of the MPEG-H 3D audio standard");
- ISO/IEC DIS 23008-3:2015/PDAM 3 document, entitled "Information technology—High efficiency coding and media delivery in heterogeneous environments—Part 3: 3D audio, AMENDMENT 3: MPEG-H 3D Audio Phase 2," by ISO/IEC JTC 1/SC 29/WG 11, dated 2015 Jul. 25 (available at: http://mpeg.chiariglione.org/standards/mpeg-h/3d-audio/text-isoiec-23008-3201xpdam-3-mpeg-h-3d-audio-phase-2, and hereinafter referred to as "phase II of the MPEG-H 3D audio standard"); and
- Jürgen Herre, et al., entitled "MPEG-H 3D Audio—The New Standard for Coding of Immersive Spatial Audio," dated August 2015 and published in Vol. 9, No. 5 of the IEEE Journal of Selected Topics in Signal Processing.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based synthesis unit 28. The directional-based synthesis unit 28 may represent a unit configured to perform a directional-based synthesis of the HOA coefficients 11 to generate a directional-based bitstream 21.

As shown in the example of FIG. 3, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, and a quantization unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set." An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$).

The individual elements of each of $v^{(i)}(k)$ vectors may represent an HOA coefficient describing the shape (including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The parameter calculation unit 32 represents a unit configured to calculate various parameters, such as a correlation parameter (R), directional properties parameters (θ, φ, r), and an energy property (e). Each of the parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield ($nBGa=(MinAmbHOAorder+1)^2$), and indices (i) of additional BG HOA channels to send (which may collectively be denoted as background channel information 43 in the example of FIG. 3). The background channel information 42 may also be referred to as ambient channel information 43. Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by $(\text{MinAmbHOAorder}+1)^2$+the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx." In any event, the soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 2 and 4, to parse the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+\text{nBGa}]$. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times$ nFG.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the psychoacoustic audio coder unit 40.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the psychoacoustic audio coder unit 46 and the interpolated foreground V[k] vectors $\mathbf{51}_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. The quantization unit 52 may perform vector quantization, scalar quantization, or scalar quantization with Huffman coding with respect to each of the reduced foreground V[k] vectors 55. The quantization unit 52 may perform different forms of quantization with respect to every frame of the bitstream 21. In other words, the quantization unit 52 may switch between different forms of quantization on a frame-by-frame basis.

The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself.

The quantization unit 52 may perform multiple forms of quantization with respect to each of the reduced foreground V[k] vectors 55 to obtain multiple coded versions of the reduced foreground V[k] vectors 55. The quantization unit 52 may select the one of the coded versions of the reduced foreground V[k] vectors 55 as the coded foreground V[k] vector 57. The quantization unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure. In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the bitstream generation unit 42 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector.

The psychoacoustic audio coder unit 40 included within the audio encoding device 20 may represent multiple instances of a psychoacoustic audio coder, each of which is used to encode a different audio object or HOA channel of each of the energy compensated ambient HOA coefficients 47' and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21 as described below in more detail with respect to the example of FIG. 7. The bitstream 21 may include a primary or main bitstream and one or more side channel bitstreams.

Although not shown in the example of FIG. 3, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER_ORDER AMBISONIC COEFFICIENTS," filed Jan. 12, 2015.

In some examples, the bitstream generation unit 42 generates the bitstreams 21 to include Immediate Play-out Frames (IPFs) to, e.g., compensate for decoder start-up delay. In some cases, the bitstream 21 may be employed in conjunction with Internet streaming standards such as Dynamic Adaptive Streaming over HTTP (DASH) or File Delivery over Unidirectional Transport (FLUTE). DASH is described in ISO/IEC 23009-1, "Information Technology—Dynamic adaptive streaming over HTTP (DASH)," April, 2012. FLUTE 15 described in IETF RFC 6726, "FLUTE—File Delivery over Unidirectional Transport," November, 2012. Internet streaming standards such as the aforementioned FLUTE and DASH compensate for frame loss/degradation and adapt to network transport link bandwidth by enabling instantaneous play-out at designated stream access points (SAPs) as well as switching play-out between representations of the stream that differ in bitrate and/or enabled tools at any SAP of the stream. In other words, the audio encoding device 20 may encode frames in such a manner as to switch from a first representation of content (e.g., specified at a first bitrate) to a second different representation of the content (e.g., specified at a second higher or lower bitrate). The audio decoding device 24 may receive the frame and independently decode the frame to switch from the first representation of the content to the second representation of the content. The audio decoding device 24 may continue to decode a subsequent frame to obtain the second representation of the content.

In the instance of instantaneous play-out/switching, pre-roll for a stream frame has not been decoded in order to establish the requisite internal state to correctly decode the frame, the bitstream generation unit 42 may encode the bitstream 21 to include Immediate Play-out Frames (IPFs). More information regarding IPFs and encoding audio data to support IPFs can be found in U.S. application Ser. No. 14/609,208, entitled "CODING INDEPENDENT FRAMES OF AMBIENT HIGHER_ORDER AMBISONIC COEFFICIENTS," filed Jan. 29, 2015. In the above referenced U.S. application Ser. No. 14/609,208, the bitstream generation unit 42 may specify an indication of whether the first frame is an independent frame that enables the first frame to be decoded without reference to a second frame of the bitstream (e.g., by specifying an hoaIndependencyFlag syntax element in a ChannelSideInfoData portion of the bitstream 21 for the first frame). When the hoaIndependencyFlag is set to one, the first frame is signaled, as one example, as an independent frame (or, in other words, and IPF). As a result of being signaled as an IPF, the bitstream generation unit 42 also signals additional reference information that would otherwise not be signaled when the frame is not indicated as being an IPF.

In certain coding situations, the audio encoding devices 20 discussed in the above noted U.S. application Ser. No. 14/594,533 and U.S. application Ser. No. 14/609,208 was specifying redundant information. For example, when an ambient HOA coefficient (e.g., one of the above referenced energy compensated HOA coefficients 47') was being faded-in during the same first frame as a foreground audio signal (e.g., the above referenced interpolated nFG audio signals 49') was being faded-in, the coefficient reduction unit 46 was including the V-vector element for the foreground V[k] vectors 53 corresponding to the ambient HOA coefficient 47', effectively specifying the V-vector element twice (once as the actual V-vector element and again in combined form as the ambient HOA coefficient 47').

The techniques described in this disclosure provide a way by which to potentially avoid specifying the redundant information. As a result of removing the redundant information, the techniques may, in addition to promoting coding efficiency, potentially improve soundfield reproduction as the redundant information may result in double the energy when reconstructing the HOA coefficient corresponding to the V-vector element. Although described below with respect to a fade-in of both one of the ambient HOA coefficient 47' and one of the interpolated nFG audio signals 49' during the same frame, the techniques may also be performed for a fade-out of both one of the ambient HOA coefficient 47' and one of the interpolated nFG audio signals 49' during the same frame.

Figure 5A:
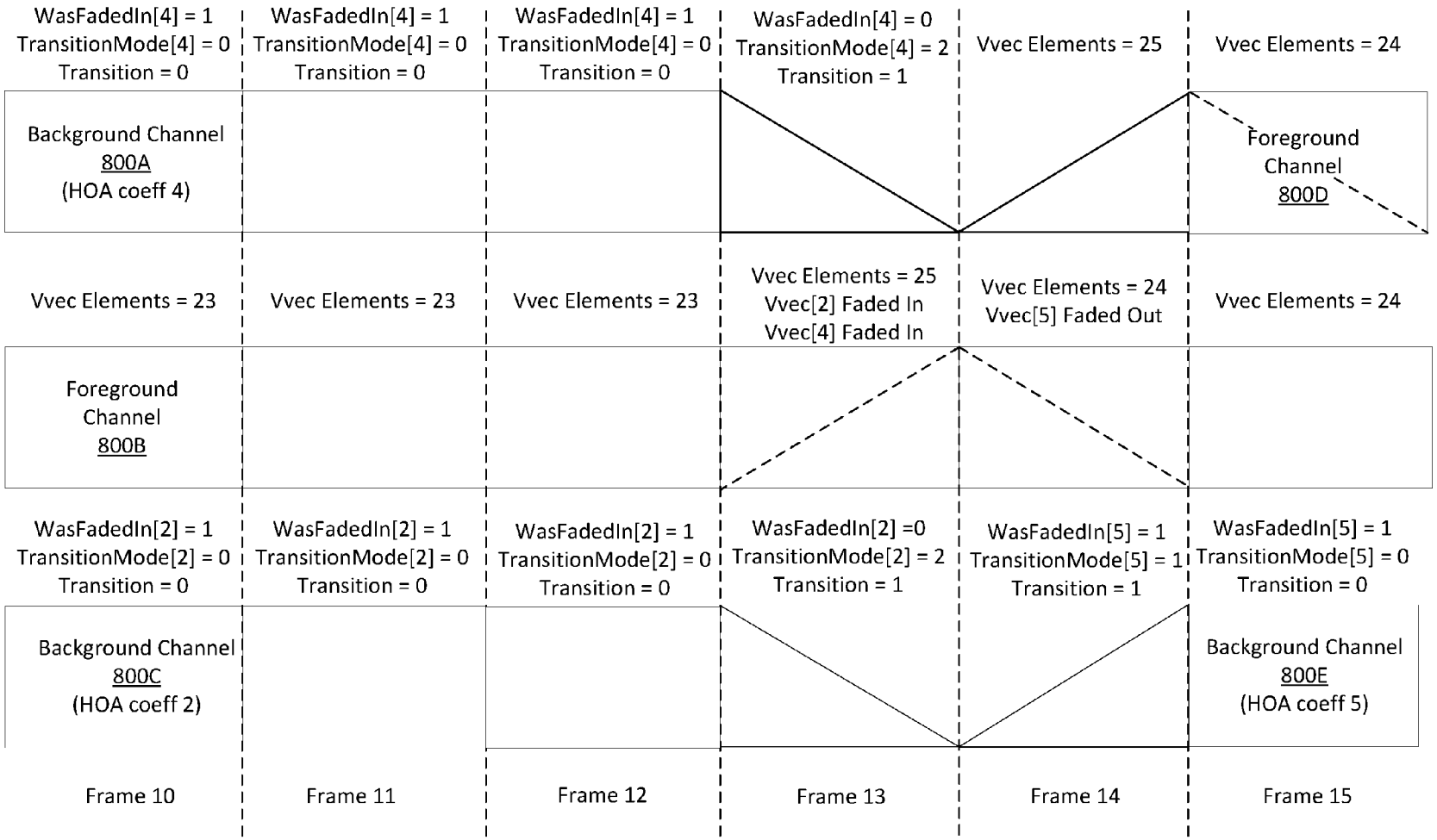
FIG. 5A is a diagram illustrating the signaling of frames in the bitstream when multiple transitions occur during the same frame.

FIG. 5A is a diagram illustrating the signaling of frames in the bitstream when multiple transitions occur during the same frame. In the example of FIG. 5A, the bitstream generation unit 42 may specify a first background channel 800A that includes one of ambient HOA coefficients 47' having an index of four. The bitstream generation unit 42 may also specify a foreground channel 800B that includes one of the interpolated nFG audio signals 49'. The bitstream generation unit 42 may also specify another background channel 800C that includes one of ambient HOA coefficients 47' having an index of two. The bitstream generation unit 42 may specify an indication of a type for each of channels 800A-800C (e.g., a ChannelType syntax element) that indicates whether the corresponding channels 800A-800C includes one of the ambient HOA coefficient 47' or one of the interpolated nFG signals 49'.

In frames 10-12 shown in the example of FIG. 5A, none of the channels 800A-800C undergo a transition. In other words, the audio encoding device 20 determines that each of channels 800A and 800C includes the same one of the ambient HOA coefficients 47' and that channel 800B includes the same one of interpolated nFG signals 49'. During frame 13, however, the soundfield analysis unit 44 determines that both of the ambient HOA coefficients 47' included in background channels 800A and 800C are to be replaced in frame 14 with a new one of the nFG audio signals 49' and a new one of the ambient HOA coefficients 47' (identified, in this example by an index of five). During frame 14, the audio encoding device 20 signals in the bitstream 21 that background channel 800A becomes a foreground channel 800D and that background channel 800C stays a background channel but includes a new one of the ambient HOA coefficients 47'.

In the example of FIG. 5A, the previous audio encoder (discussed in the above noted U.S. application Ser. No. 14/594,533 and U.S. application Ser. No. 14/609,208) indicated that all 25 elements were signaled for the foreground channel 800D. In this respect, the previous audio encoder would specify redundant information in specifying all 25 v-vector elements (Vvec Elements=25) while such element is signaled in full HOA form as an additional ambient HOA coefficient in background channel 800E. The previous audio encoder, in frame 15, then fades out the v-vector elements corresponding to the additional ambient HOA coefficients specified in background channel 800E, resulting in only 24 Vvec elements, The previous audio decoder (discussed in the above noted U.S. application Ser. No. 14/594,533 and U.S. application Ser. No. 14/609,208) received all 25 v-vector elements via the foreground channel 800D along with the additional ambient HOA coefficient from the background channel 800E. In reconstructing the HOA coefficients, the previous audio decoder utilizes all 25 v-vector elements to obtain the foreground HOA coefficients and next combines the foreground HOA coefficients with the redundant additional ambient HOA coefficients, resulting in energy amplification given that the redundant information being utilized twice when reconstructing the HOA coefficients.

Figure 5B:
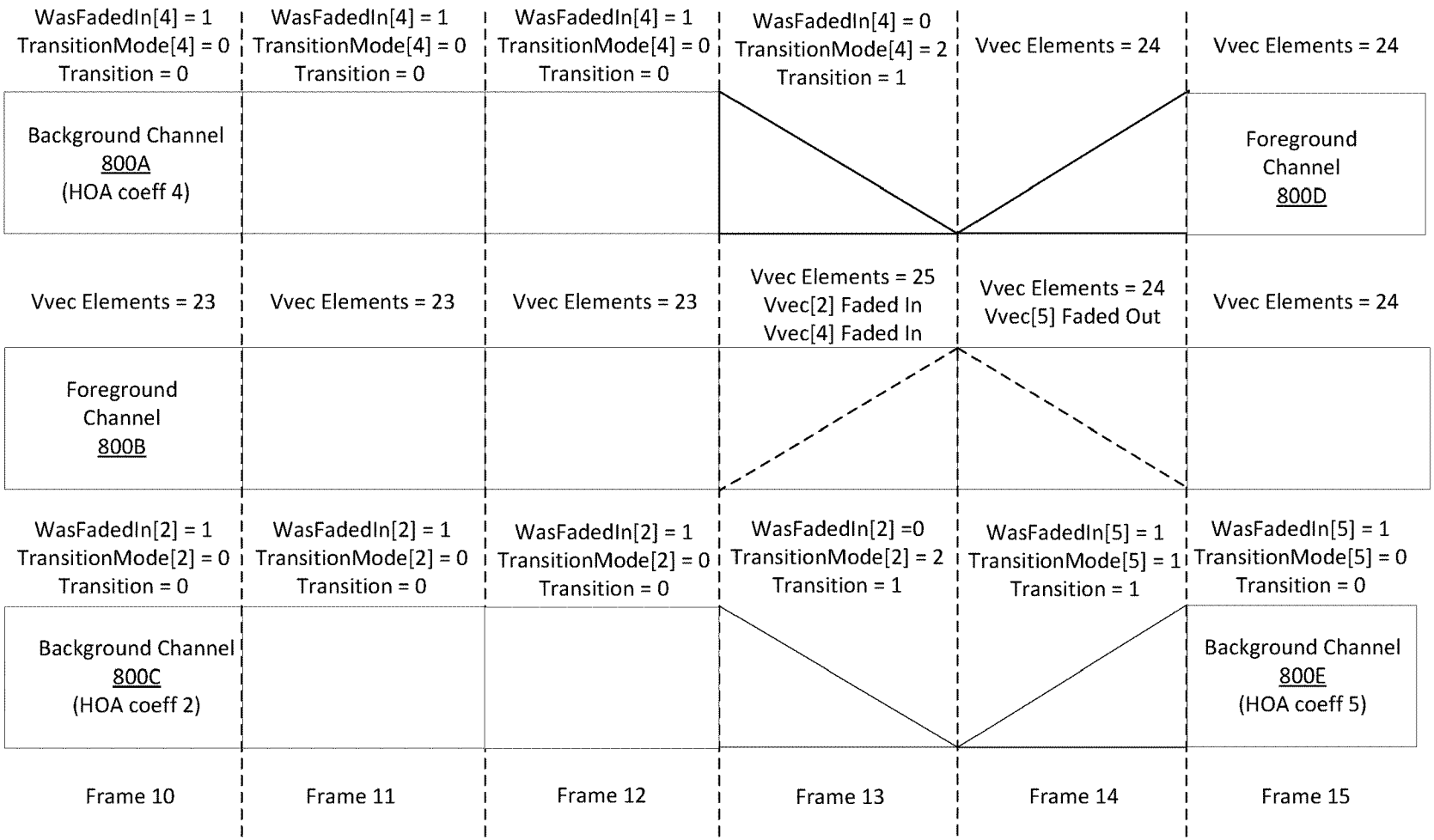
FIG. 5B is a diagram illustrating the signaling of frames in the bitstream when multiple transitions occur during the same frame in accordance with various aspects of the techniques described in this disclosure.

FIG. 5B is a diagram illustrating the signaling of frames in the bitstream when multiple transitions occur during the same frame in accordance with various aspects of the techniques described in this disclosure. To avoid specifying the V-vector element associated with the one of the ambient HOA coefficients 47' included in the background channel 800E, the soundfield analysis unit 44 may track or otherwise obtain an indication of a number of new additional ambient HOA coefficients (e.g., in the form of a NumOfNewAddHoaChans variable) as shown in the following HOAFrame( ) syntax table. Although the HOAFrame( ) syntax table is specified from the decoding perspective, the soundfield analysis unit 44 may operate in a manner similar to that described by the audio decoding device 24 so as to generate the appropriate syntax elements that ensure that the audio decoding device 24 may parse and decode the bitstream 21.

Syntax of HOAFrame( ):

| Syntax | No. of bits | Mnemonic |
|---|---|---|
| HOAFrame( ) | | |
| { | | |
| NumOfDirSigs = 0; | | |
| NumOfVecSigs = 0; | | |
| NumOfContAddHoaChans = 0; | | |
| *NumOfNewAddHoaChans = 0;* | | |
| NumOfAddHoaChans = 0; | | |
| **hoaIndependencyFlag;** | **1** | **bslbf** |
| for(i=0; i< NumOfAdditionalCoders; ++i){ | | |
| ChannelSideInfoData(i); | | |
| HOAGainCorrectionData(i); | | |
| switch ChannelType[i] { | | |
| case 0: | | |
| DirSigChannelIds[NumOfDirSigs] = i + 1; | | |
| NumOfDirSigs++; | | |
| break; | | |
| case 1: | | |
| VecSigChannelIds[NumOfVecSigs] = i + 1; | | |
| NumOfVecSigs++; | | |
| break; | | |
| case 2: | | |
| if (AmbCoeffTransitionState[i] == 0) { | | |
| ContAddHoaCoeff [NumOfContAddHoaChans] = AmbCoeffIdx[i]; | | |
| NumOfContAddHoaChans++; | | |
| }*else*{ | | |
| *if(AmbCoeffTransitionState[i] == 1)* { | | |
| *NewAddHoaCoeff [NumOfNewAddHoaChans]= AmbCoeffIdx[i];* | | |
| *NumOfNewAddHoaChans+ +;* | | |
| } | | |
| } | | |
| AddHoaCoeff[NumOfAddHoaChans] = AmbCoeffIdx[i]; | | |
| NumOfAddHoaChans++; | | |
| break; | | |
| } | | |
| } | | |
| for ( i= NumOfAdditionalCoders; i< NumHOATransportChannels; ++i){ | | |
| HOAGainCorrectionData(i); | | |
| } | | |
| for(i=0; i< NumOfVecSigs; ++i){ | | |
| VVectorData ( VecSigChannelIds(i) ); | | |
| } | | |
| if(NumOfDirSigs > 0){ | | |
| HOAPredictionInfo( DirSigChannelIds, NumOfDirSigs ) | | |
| } | | |
| if( NumOfPredSubbands > 0) { | | |
| HOADirectionalPredictionInfo( ); | | |
| } | | |
| if( NumOfParSubbands > 0) { | | |
| HOAParInfo( ); | | |
| } | | |
| } | | |

NOTE:
the encoder shall set hoaIndependencyFlag to 1 if usacIndependencyFlag (see mpegh3daFrame( ) in phase I or II of the above noted MPEG-H 3D audio standard) is set to 1.

The italicized items in the HOAFrame( ) syntax table above denote additions to the syntax to accommodate various aspects of the techniques described in this disclosure. The soundfield analysis unit 44 may, as shown in the above HOAFrame( ) syntax table, initialize an indication of the number of new additional ones of the ambient HOA coefficients 47' (e.g., the NumOfNewAddHoaChans variable) to zero at the start of coding each frame. In other words, the soundfield analysis unit 44 may obtain an indication of a number of ambient HOA coefficients that are in transition during a first frame of the bitstream, the ambient HOA coefficient describing an ambient component of a soundfield represented by the HOA audio data. The additional ones of the ambient HOA coefficients 47' may refer to the ambient HOA coefficients 47' not identified by the indication of the minimum ambient HOA coefficients (e.g., the MinAmbHoaOrder syntax element specified in the HOADecoderConfig( ) syntax table of phase I of the MPEG-H 3D audio coding standard). The additional ones of the ambient HOA coefficients 47' are also identified by an indication of the type of the channel (e.g., the ChannelType syntax element) indicating a type of two per phase I of the MPEG-H 3D audio coding standard.

In this respect, when the type of the channel is two, the soundfield analysis unit 44 may switch to case two (2) in the above syntax table, and determine when the transition state equals one (which in the example indicates a transition, meaning either a fade-in or a fade-out). When the soundfield analysis unit 44 determines that background channel 800A is to transition to foreground channel 800D, the soundfield analysis unit 44 may obtain an indication indicating which of the ambient HOA coefficients are in transition during the frame of the bitstream (e.g., in the form of a NewAddHoaCeff[NumOfNewAddHoaChans] variable). The soundfield analysis unit 44 may also increment the NumOfNewAddHoaChans by one (i.e., shown as NumOfNewAddHoaChans++ in the above example syntax table).

The soundfield analysis unit 44 may provide the above noted indications to the coefficient reduction unit 43 as part of the background channel information 43. In some examples, the coefficient reduction unit 46 may obtain the above indications (rather than the soundfield analysis unit 44) based on the background channel information 43 specified above. The coefficient reduction unit 46 may obtain an indication of whether an ambient HOA coefficient is in transition during the same first frame of the bitstream as the foreground audio signal is in transition based on the NumOfNewAddHoaChans variable.

The coefficient reduction unit 46 may also determine a foreground indication of whether one of the foreground audio signal 49' is in transition during a first frame of the bitstream (e.g., frame 14 in the example of FIG. 5B), the foreground audio signals describing a foreground component of a soundfield represented by the HOA audio data 11 and decomposed from the HOA audio data 11. The coefficient reduction unit 46 may obtain the foreground indication in a manner similar to that shown in the ChannelSideInfoData( ) syntax table. Again, although the following syntax table is specified from the decoding perspective, the coefficient reduction unit 46 may operate in a manner similar to that described by the audio decoding device 24 so as to generate the appropriate syntax elements that ensure that the audio decoding device 24 may parse and decode the bitstream 21.

Syntax of ChannelSideInfoData( ):

| Syntax | No. of bits | Mnemonic |
|---|---|---|
| ChannelSideInfoData(i) | | |
| { | | |
| **ChannelType[i]** | **2** | **uimsbf** |
| switch ChannelType[i] | | |
| { | | |
| case 0: | | |
| **ActiveDirsIds[i];** | **10** | **uimsbf** |
| break; | | |
| case 1: | | |
| if(hoaIndependencyFlag){ | | |
| *if(CodedVVecLength==1){* | | |
| ***bNewChannelTypeOne(k)[i];*** | ***1*** | ***bslbf*** |
| ***}*** | | |
| **NbitsQ**(k)[i] | **4** | **uimsbf** |
| if (NbitsQ(k)[i] == 4){ | | |
| **CodebkIdx**(k)[i]; | **3** | **uimsbf** |
| **NumVvedndices**(k)[i]++; | **NumVVecVqElementsBits** | **uimsbf** |
| } | | |
| elseif (NbitsQ(k)[i] >= 6) { | | |
| PFlag(k)[i] = 0; | | |
| **CbFlag**(k)[i]; | **1** | **bslbf** |
| } | | |
| } | | |
| else{ | | |
| *if(CodedVVecLength==1){* | | |
| *bNewChannelTypeOne(k)[i] = (1!=ChannelType(k−1)[i]));* | | |
| } | | |
| **bA;** | **1** | **bslbf** |
| **bB;** | **1** | **bslbf** |
| if ((bA + bB) == 0) { | | |
| NbitsQ(k)[i] = NbitsQ(k−1)[i]; | | |
| PFlag(k)[i] = PFlag(k−1)[i]; | | |
| CbFlag(k)[i] = CbFlag(k−1)[i]; | | |
| CodebkIdx(k)[i] = CodebkIdx(k−1)[i]; | | |
| NumVvecIndices(k)[i] = NumVvecIndices(k−1)[i]; | | |
| } | | |
| else{ | | |
| NbitsQ(k)[i] = (8*bA)+(4*bB)+**uintC**; | **2** | **uimsbf** |
| if (NbitsQ(k)[i] == 4) { | | |
| **CodebkIdx**(k)[i]; | **3** | **uimsbf** |
| **NumVveIndices**(k)[i]++; | **NumVVecVqElementsBits** | **uimsbf** |
| } | | |

-continued

| Syntax of ChannelSideInfoData( ): | | |
|---|---|---|
| Syntax | No. of bits | Mnemonic |
| elseif (NbitsQ(k)[i] >=6 ) { | | |
| **PFlag**(k)[i]; | **1** | **bslbf** |
| **CbFlag**(k)[i]; | **1** | **bslbf** |
| } | | |
| } | | |
| } | | |
| break; | | |
| case 2: | | |
| AddAmbHoaInfoChannel(i); | | |
| break; | | |
| default: | | |
| } | | |
| } | | |

NOTE
CodebkIdx = 3 . . . 6 are reserved.

Again, the italicized items in the above syntax table denote additions to the syntax to accommodate various aspects of the techniques described in this disclosure. The foreground indication is denoted in the ChannelSideInfo( ) syntax table as the bNewChannelTypeOne(k)[i] syntax element. The bNewChannelTypeOne syntax element may also be denoted in some instances of the Channel SideInfoData syntax table as "NewChannelTypeOne," removing the letter 'b' before the "NewChannelTypeOne" term. The coefficient reduction unit 46 may obtain the foreground indication based on an indication of a type of the transport channel 800A of the preceding frame 13 (i.e., shown as the ChannelType syntax element in the above example syntax table).

More specifically, the coefficient reduction unit 46 may obtain the foreground indication in accordance with the following pseudocode:

$$b\text{NewChannelTypeOne}(k)[i]=(1!=\text{ChannelType}(k-1)[i]).$$

In the pseudocode, the coefficient reduction unit 46 may obtain the foreground indication for the frame 14 (which may be referred to as the first frame) based on the type for the transport channel 800A of frame 13 (which may be referred to as the second frame, the preceding frame, or the directly preceding frame). In accordance with the above pseudocode, the coefficient reduction unit 46 may obtain the foreground indication for the first frame as equal to one when the ChannelType syntax element for the second frame is not equal to one and as equal to zero when the ChannelType syntax element for the second frame is equal to one.

In this respect, the foreground indication (bNewChannelTypeOne[i]) represents a flag that indicates if, in the previous frame (k−1), the transport channel was not initialized as a vector-based signal (or, in other words, did not include one of the interpolated nFG audio signals 49'). In the example of FIG. 5B, the coefficient reduction unit 46 may determine that the bNewChannelTypeOne syntax element for the foreground channel 800D is equal to one for frame 14. The foreground indication may in this respect indicate whether the same transport channel of the second frame includes a foreground audio signal decomposed from the higher-order ambisonic audio data. Stated differently, the foreground indication may indicate whether a foreground audio signal is in transition during a first frame of the bitstream.

As noted in the above ChannelSideInfo( ) syntax table, the coefficient reduction unit 46 may obtain the foreground indication, in some examples, only when a coding mode for the V-vector corresponding to the one of the interpolated nFG audio signals 49' being faded-in is set to one (as indicated by the indication CodedVVecLength syntax element being set to one). The coding mode identified by the CodedVVecLength syntax element being set to one results in the coefficient reduction unit 46 sending a reduced V-vector, which as described in the above U.S. application Serial Nos. may refer to a V-vector for which elements corresponding to the minimum ambient HOA coefficients and the additional ambient HOA coefficients are removed.

The coefficient reduction unit 46 may, in some examples, obtain the multi-transition indication of whether the one of the ambient HOA coefficient 47' is in transition during a same first frame of the bitstream as one of the foreground audio signal 49' is in transition based on the background indication (which may be another way to refer to the NumOfNewAddHoaChans variable), the foreground indication (which may be another way to refer to the bNewChannelTypeOne[i] syntax element, where the variable i denotes the index of the transport channel), or both the background indication and the foreground indication. The background indication may also be referred to as an ambient indication. The foreground indication may also be referred to as a predominant indication. The coefficient reduction unit 46 may determine the multi-transition indication as the foreground indication multiplied by the background indication (which may be denoted as bNewChannelTypeOne[i]*NumOfNewAddHoaChans).

The coefficient reduction unit 46 may then iterate through the transport channels to determine which of the new additional ambient HOA coefficients 47' are being faded-in during the same first frame as one of the nFG audio signals 49' are faded-in. The coefficient reduction unit 46 may then remove the V-vector element corresponding to the new one of the ambient HOA coefficients 47' being faded in (e.g., shown as background channel 800E in FIG. 5B) when another foreground channel (e.g., foreground channel 800D) is faded-in during the same frame (e.g., frame 14 in FIG. 5B).

In the example of FIG. 5B, the coefficient reduction unit 46 may remove the V-vector element associated with the one of the ambient HOA coefficient 47' identified by the fifth index (as shown in background channel 800E). As such, the foreground channel 800D includes only 24 vector elements for a fourth order representation having a total of 25 v-vector elements (which is denoted by Vvec elements=24 in the example of FIG. 5B). The coefficient reduction unit 46 may, because V-vec element[5] was specified in the previous frame, fade out the V-vec element[5] corresponding to the one of the ambient HOA coefficients 47' identified by an index of 5, as discussed in the U.S. application Serial Nos. referenced above. The remaining WasFadedIn, TransitionMode and Transition items shown in FIG. 5B are also described in more detail in the above referenced U.S. application Serial Nos.

In this way, the coefficient reduction unit 46 may obtain one of the reduced V[k] vectors 55 (which may represent a vector that describes a spatial characteristic of a corresponding one of the interpolated nFG audio signals 49') based on the multi-transition indication, where both the vector and the corresponding HOA audio signal are decomposed from the HOA audio data, as described above.

In some embodiments, the bitstream generation unit 42 may, as noted above, specify an indication of whether the first frame is an independent frame that enables the first frame to be decoded without reference to a second frame of the bitstream (i.e., the hoaIndependencyFlag syntax element). Per the above ChannelSideInfo( ) syntax table, the bitstream generation unit 42 may specify foreground indication when the hoaIndependencyFlag indicates that the first frame is an independent frame (i.e., "if(hoaIndpendencyFlag)" in the above example syntax table, meaning that the hoaIndependencyFlag is equal to one). The bitstream generation unit 42 may specify the foreground indication when the first frame is an independent frame because the frame has to be decoded without reference to any other frame or any other syntax elements from another frame. Given that the foreground indication is determined based on the ChannelType for a previous frame (k−1), the bitstream generation unit 42 specifies the foreground indication when the first frame is an independent frame. Although described above with respect to the audio encoding device 20, the audio decoding device 24 may perform operations reciprocal to that of the audio encoding device 20. The reciprocal operations performed by the audio decoding device 24 are described in more detail below with respect to the example of FIG. 4.

Figure 4:
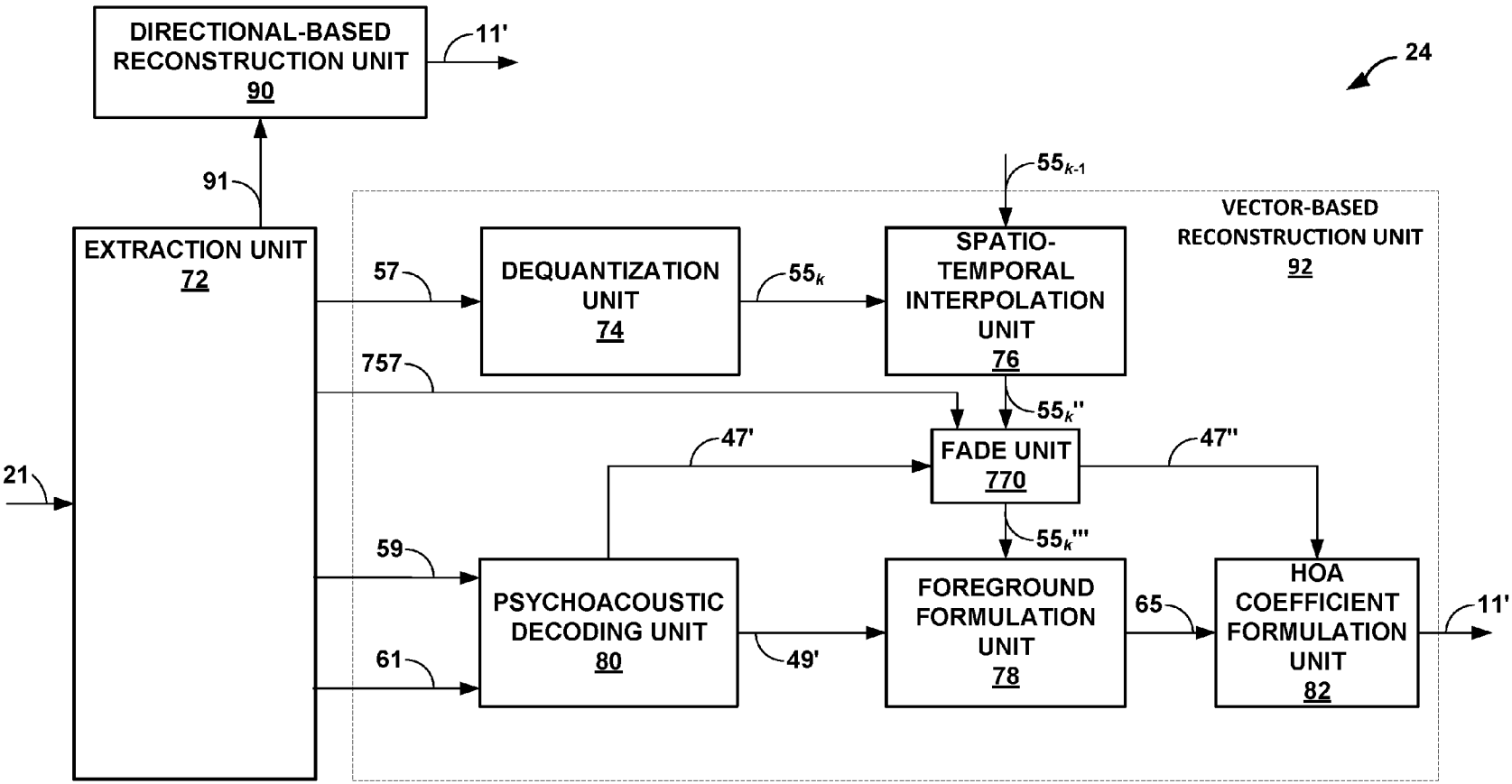
FIG. 4 is a block diagram illustrating the audio decoding device of FIG. 2 in more detail.

FIG. 4 is a block diagram illustrating the audio decoding device 24 of FIG. 2 in more detail. As shown in the example of FIG. 4 the audio decoding device 24 may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014.

The extraction unit 72 may represent a unit configured to receive the bitstream 21 and extract the various encoded versions (e.g., a directional-based encoded version or a vector-based encoded version) of the HOA coefficients 11. The extraction unit 72 may determine from the above noted syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (which is denoted as directional-based information 91 in the example of FIG. 4), passing the directional based information 91 to the directional-based reconstruction unit 90. The directional-based reconstruction unit 90 may represent a unit configured to reconstruct the HOA coefficients in the form of HOA coefficients 11' based on the directional-based information 91.

When the syntax element indicates that the HOA coefficients 11 were encoded using a vector-based synthesis, the extraction unit 72 may extract the coded foreground V[k] vectors 57 (which may include coded weights 57 and/or indices 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the psychoacoustic decoding unit 80.

The extraction unit 72 may also operate in the manner described above with respect to the audio encoding device 20 to obtain the various syntax elements and variables set described above with respect to the HOAFrame syntax table and the ChannelSideInfo( ) syntax table. The extraction unit 72 may obtain any combination of the background indication, the foreground indication, the independent frame indication (which may refer to the above hoaIndependencyFlag), and the multi-transition indication.

The extraction unit 72 may obtain the coded foreground V[k] vectors 57 from the bitstream 21 based on any one of the background indication, the foreground indication, the independent frame indication (which may refer to the above hoaIndependencyFlag), and the multi-transition indication. The extraction unit 72 may, when the CodedVVecLength syntax element indicates a coding mode of 1, operate in accordance with the following pseudocode to extract the coded foreground V[k] vectors 57.

```
switch CodedVVecLength{
case 1:
VVecLength[i] = NumOfHoaCoeffs − MinNumOfCoefFsForAmbHOA −
NumOfContAddHoaChans − (bNewChannelTypeOne[i] *
NumOfNewAddHoaChans);
        CoeffIdx = MinNumOfCoeffsForAmbHOA+1;
        for (m=0; m<VVecLength; ++m){
            if(bNewChannelTypeOne[i]) {
                bIsInArray = ( isMemberOf(CoeffIdx, ContAddHoaCoeff,
NumOfContAddHoaChans) || isMemberOf(CoeffIdx, NewAddHoaChans,
NumOfNewAddHoaChans) );
                while (bIsInArray) {
                    CoeffIdx++;
                    bIsInArray = ( (isMemberOf(CoeffIdx,
```

-continued

```
ContAddHoaCoeff, NumOfContAddHoaChans) || isMemberOf(CoeffIdx,
NewAddHoaChans, NumOfNewAddHoaChans) );
                }
            } else {
                bIsInArray = isMemberOf(CoeffIdx,
ContAddHoaCoeff, NumOfContAddHoaChans)
                while (bIsInArray) {
                    CoeffIdx++;
                    bIsInArray = isMemberOf(CoeffIdx,
ContAddHoaCoeff, NumOfContAddHoaChans);
                }
            }
            VVecCoeffId[m] = CoeffIdx-1;
    }
break;
```

The above bold italicized items in the above pseudocode denote updates to phase I or II or the 3D audio coding standard. The foregoing pseudocode indicates that the extraction unit 72 may determine the number of elements of the coded foreground V[k] vectors 57 based on the multi-transition indication (e.g., the foreground indication, e.g., bNewChannelTypeOne[i], multiplied by the background indication, e.g., NumOfNewAddHoaChans). The extraction unit 72 may in this respect act in the manner reciprocal to the manner in which the audio encoding device 20 is described as performing the techniques described in this disclosure with respect to the examples of FIGS. 3 and 5B.

With respect to the example of FIG. 5B, the extraction unit 72 may determine, based on the multi-transition indication, that there are only 24 v-vector elements in frames 14 and 15. As such, the extraction unit 72 may extract only 24 v-vector elements from foreground channel 800D rather than the 25 v-vector elements that the previous audio decoder extracts when not performing the techniques described in this disclosure. As such, the extraction unit 72 may not extract redundant information, thereby potentially avoiding the amplification described above that results from including the redundant information when reconstructing the HOA coefficients.

In this respect, the audio decoding device 24 may, in a first example, obtain a multi-transition indication of whether an ambient HOA coefficient is in transition during a same first frame of the bitstream as a foreground audio signal is in transition, and obtaining a vector that describes a spatial characteristic of a corresponding foreground audio signal based on the multi-transition indication, both the vector and the corresponding HOA audio signal are decomposed from the HOA audio data.

The audio decoding device 24 of the first example may, in the second example, obtain a background indication of a number of ambient HOA coefficients that are in transition during the first frame of the bitstream, where obtaining the multi-transition indication comprises obtaining the multi-transition indication based on the background indication.

The audio decoding device 24 of any combination of the first and second examples may, in a third example, obtain a foreground indication of whether a foreground audio signal is in transition during a frame of the bitstream, where obtaining the multi-transition indication comprises obtaining the multi-transition indication based on the foreground indication.

The audio decoding device 24 of any combination of the first through third examples may, in a fourth example, obtain a background indication of a number of ambient HOA coefficients that are in transition during a frame of the bitstream, and obtain a foreground indication of whether a foreground audio signal is in transition during a frame of the bitstream, where obtaining the multi-transition indication comprises obtaining the multi-transition indication based on the foreground indication and the background indication.

The audio decoding device 24 of any combination of the first through fourth examples may, in a fifth example, obtain the background indication in response to an indication indicating that a transition has occurred with respect to one of the ambient HOA coefficients.

The audio decoding device 24 of any combination of the first through fifth examples may, in a sixth example, obtain an indication indicating which of the ambient HOA coefficients are in transition during the frame of the bitstream.

The audio decoding device 24 of any combination of the first through sixth examples may, in a seventh example, obtain, when a coding mode of a vector corresponding to the foreground audio signal indicates that the vector is a reduced vector, the foreground indication based on an indication of a type for a transport channel of a second frame of the bitstream.

The audio decoding device 24 of any combination of the first through seventh examples may, in an eighth example, obtain, from the first frame of the bitstream, an independent frame indication of whether the first frame is an independent frame that enables the first frame to be decoded without reference to a second frame (or, in other words, a different frame) of the bitstream.

The audio decoding device 24 of any combination of the first through eighth examples may, in a ninth example, obtain, from the bitstream, the foreground indication in response to the independent frame indication indicating that the first frame is an independent frame.

The audio decoding device 24 of any combination of the first through ninth examples may, in a tenth example, obtain, in response to the independent frame indication indicating that the first frame is not an independent frame, an indication of a type for the transport channel of the second frame.

The audio decoding device 24 of any combination of the first through tenth examples may, in an eleventh example, obtain the foreground indication for the transport channel of the first frame indicating whether the same transport channel of the second frame included the vector-based audio signal based on the indication of the type for the transport channel of the second frame.

The audio decoding device 24 of any combination of the first through eleventh examples may, in a twelfth example, obtain, when a coding mode of a vector corresponding to the foreground audio signal indicates that the vector is a reduced vector, the foreground indication for the transport channel of the first frame indicating whether the same transport channel of the second frame included the vector-based audio signal based on the indication of the type for the transport channel of the second frame.

The audio decoding device 24 of any combination of the first through twelfth examples may, in a thirteenth example, obtain the independent frame indication for the transport channel of the first frame indicating whether the same transport channel of the second frame included the vector-based audio signal when a coding mode of a vector corresponding to the foreground audio signal indicates that the vector is a reduced vector.

In any combination of the foregoing first through thirteenth examples, the vector is, in a fourteenth example, decomposed from the HOA audio data.

In any combination of the foregoing first through fourteenth examples, the multi-transition indication, in a fifteenth example, indicates whether the ambient HOA coefficient is faded-in during the same first frame of the bitstream as the foreground audio signal is faded-in.

In any combination of the foregoing first through fifteenth examples, multi-transition indication indicates, in a sixteenth example, whether the ambient HOA coefficient is faded-out during the same first frame of the bitstream as the foreground audio signal is faded-out.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52.

The psychoacoustic decoding unit 80 may operate in a manner reciprocal to the psychoacoustic audio coder unit 40 shown in the example of FIG. 3 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to the fade unit 770 and the nFG signals 49' to the foreground formulation unit 78.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k''$. The spatio-temporal interpolation unit 76 may forward the interpolated foreground V[k] vectors $\mathbf{55}_k''$ to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47'" or "ambient HOA coefficients 47'") and the elements of the interpolated foreground V[k] vectors $\mathbf{55}_k''$ are to be either faded-in or faded-out. In some examples, the fade unit 770 may operate opposite with respect to each of the ambient HOA coefficients 47' and the elements of the interpolated foreground V[k] vectors $\mathbf{55}_k''$. That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $\mathbf{55}_k''$. The fade unit 770 may output adjusted ambient HOA coefficients 47" to the HOA coefficient formulation unit 82 and adjusted foreground V[k] vectors $\mathbf{55}_k'''$ to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k''$.

The foreground formulation unit 78 may represent a unit configured to perform matrix multiplication with respect to the adjusted foreground V[k] vectors $\mathbf{55}_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $\mathbf{55}_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k'''$.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

Figure 6:
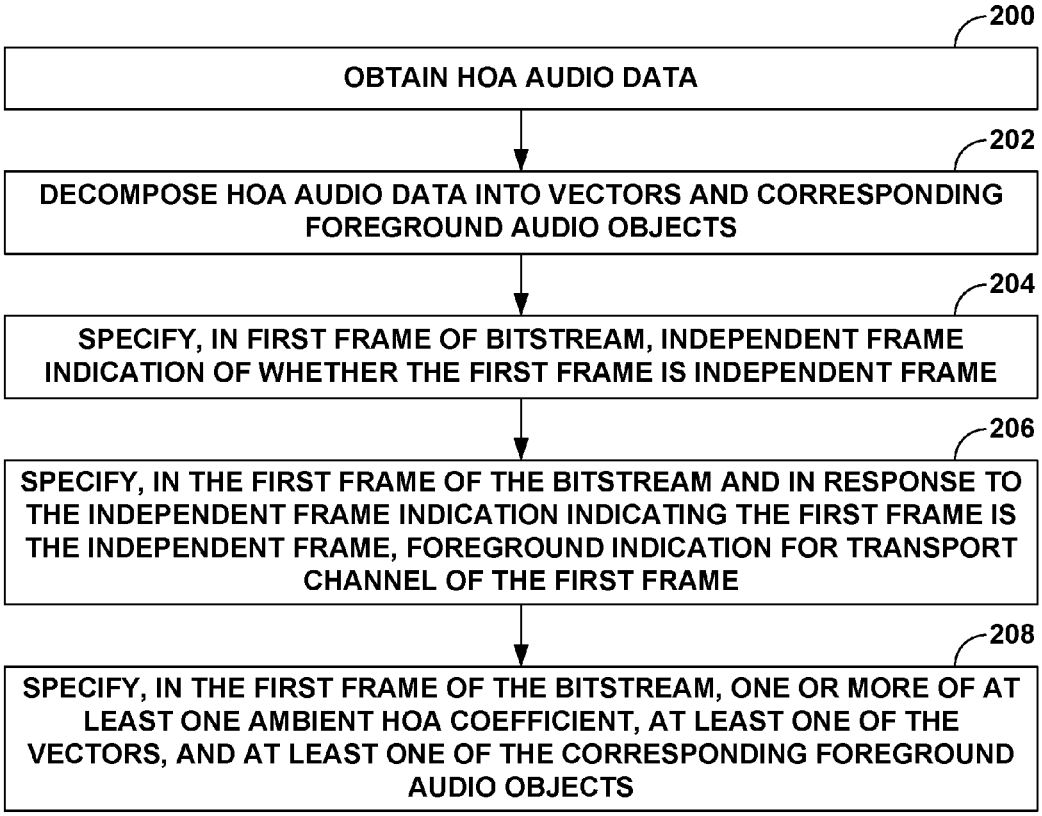
FIGS. 6-9 are flowcharts illustrating example operation of the audio encoding device shown in FIG. 2 in performing various aspects of the techniques described in this disclosure.

FIGS. 6-9 are flowcharts illustrating example operation of the audio encoding device 20 in performing various aspects of the techniques described in this disclosure. In the example of FIG. 6, the audio encoding device 20 may first obtain HOA audio data (200). The audio encoding device 20 may couple to one or more microphones to capture or otherwise obtain the HOA audio data. The audio encoding device 20 may next decompose the HOA audio data into vectors and corresponding foreground audio objects in the manner described above (202). The audio encoding device 20 may specify the corresponding foreground audio objects in a first frame of the bitstream.

The audio encoding device 20 may specify, in the first frame of the bitstream, an independent frame indication of whether the first frame is an independent frame that enables the first frame to be decoded without reference to a second frame of the bitstream, as described above (204). The audio encoding device 20 may also specify, in the first frame of the bitstream and in response to the independent frame indication indicating that the first frame is an independent frame, a foreground indication for a transport channel of the first frame (206). As described above, the foreground indication may indicate whether the same transport channel of the second frame includes the foreground audio signal decomposed from the higher-order ambisonic audio data. The audio encoding device 20 may specify, in the first frame of the bitstream, one or more of at least one ambient HOA coefficient, at least one of the vectors, and at least one of the corresponding foreground audio objects (208).

The techniques may enable the audio encoding device 20 configured to perform the aspects of clause 1A shown in FIG. 6 to operate in accordance with the following dependent clauses.

Clause 2A. The device of clause 1A (e.g., the audio coding device 20 configured to operate in accordance with the various aspects of the techniques described with respect to the example of FIG. 6) further configured to specify, in response to the independent frame indication indicating that the first frame is not an independent frame, an indication of a type for the transport channel of the second frame.

Clause 3A. The device of clause 2A being configured to specify the foreground indication for the transport channel of the first frame indicating whether the same transport channel of the second frame included the vector-based audio signal based on the indication of the type for the transport channel of the second frame.

Clause 4A. The device of clause 2A being configured to specify, when a coding mode of a vector corresponding to the foreground audio signal indicates that the vector is a reduced vector, the foreground indication for the transport channel of the first frame indicating whether the same transport channel of the second frame included the vector-based audio signal based on the indication of the type for the transport channel of the second frame.

Clause 5A. The device of clause 1A being configured to specify the independent frame indication for the transport channel of the first frame indicating whether the same transport channel of the second frame included the vector-based audio signal when a coding mode of a vector corresponding to the foreground audio signal indicates that the vector is a reduced vector.

Clause 6A. The device of any combination of clauses 4A and 5A, wherein the vector is decomposed from the HOA audio data.

Clause 7A. The device of clause 1A further configured to specify a background indication of a number of ambient HOA coefficients that are in transition during the first frame of the bitstream, and specify, based on the background indication, a multi-transition indication of whether an ambient HOA coefficient is in transition during the same first frame of the bitstream as the foreground audio signal is in transition.

Clause 8A. The device of clause 1A or 7A further configured to specify, based on the foreground indication, the background indication or both the foreground indication and the background indication, a multi-transition indication of whether an ambient HOA coefficient is in transition during the same first frame of the bitstream as the foreground audio signal is in transition.

Clause 9A. The device of clause 7A or 8A being configured to specify the background indication in response to an indication indicating that a transition has occurred with respect to one of the ambient HOA coefficients.

Clause 10A. The device of clause 7A or 8A being configured to specify an indication indicating which of the ambient HOA coefficients are in transition during the frame of the bitstream.

Clause 11A. The device of clause 8A being configured to specify, when a coding mode of a vector corresponding to the foreground audio signal indicates that the vector is a reduced vector, the foreground indication based on an indication of a type for a transport channel of a second frame of the bitstream.

Clause 12A. The device of any of clauses 7A-11A, wherein the multi-transition indication indicates whether the ambient HOA coefficient is faded-out during the same first frame of the bitstream as the foreground audio signal is faded-in.

Clause 13A. The device of any of clauses 7A-11A, wherein the multi-transition indication indicates whether the ambient HOA coefficient is faded-out during the same first frame of the bitstream as the foreground audio signal is faded-out.

Clause 14A. The device of any combination of claims 7A-13A further configured to specify a vector that describes a spatial characteristic of a corresponding foreground audio signal based on the multi-transition indication, both the vector and the corresponding HOA audio signal decomposed from the HOA audio data.

Figure 7:
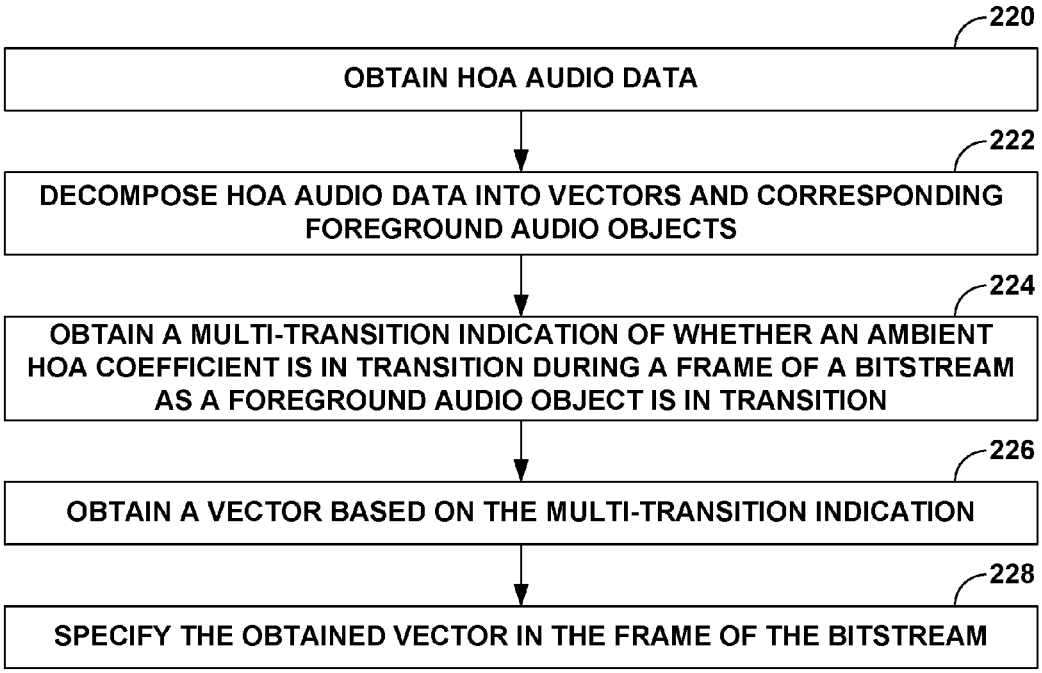

In the example of FIG. 7, the audio encoding device 20 may first obtain HOA audio data (220). The audio encoding device 20 may couple to one or more microphones to capture or otherwise obtain the HOA audio data. The audio encoding device 20 may next decompose the HOA audio data into vectors and corresponding foreground audio objects in the manner described above (222). The audio encoding device 20 may specify the corresponding foreground audio objects in a first frame of the bitstream.

The audio encoding device 20 may also obtain a multi-transition indication of whether an ambient HOA coefficient is in transition during the frame of the bitstream as a foreground audio object is in transition, as described above (224). The audio encoding device 20 may also obtain a vector (that as described above represents a spatial characteristic of the corresponding foreground audio signal) based on the multi-transition indication (226). As described above, both the vector and the corresponding foreground audio signal may be decomposed from the HOA audio data. The audio encoding device 20 may specify the obtained vector in the frame of the bitstream (228).

The techniques may enable the audio encoding device 20 configured to perform the aspects of clause 1B shown in FIG. 7 to operate in accordance with the following dependent clauses.

Clause 2B. The device of clause 1B (e.g., the audio coding device 20 configured to operate in accordance with the various aspects of the techniques described with respect to the example of FIG. 7) further configured to obtain a background indication of a number of ambient HOA coefficients that are in transition during the first frame of the bitstream, and being configured to obtain the multi-transition indication based on the background indication.

Clause 3B. The device of clause 1B further configured to obtain a foreground indication of whether a foreground audio signal is in transition during a frame of the bitstream, and being configured to obtain the multi-transition indication based on the foreground indication.

Clause 4B. The device of clause 1B further configured to obtain a background indication of a number of ambient HOA coefficients that are in transition during a frame of the bitstream, obtain a foreground indication of whether a foreground audio signal is in transition during a frame of the bitstream, and being configured to obtain the multi-transition indication based on the foreground indication and the background indication.

Clause 5B. The device of clauses 2B or 4B being configured to obtain the background indication in response to an indication indicating that a transition has occurred with respect to one of the ambient HOA coefficients.

Clause 6B. The device of clause 2B or 4B being configured to obtain an indication indicating which of the ambient HOA coefficients are in transition during the frame of the bitstream.

Clause 7B. The device of clause 3B or 4B being configured to obtain, when a coding mode of a vector corresponding to the foreground audio signal indicates that the vector is a reduced vector, the foreground indication based on an indication of a type for a transport channel of a second frame of the bitstream.

Clause 8B. The device of clause 3B or 4B further configured to obtain an independent frame indication of whether the first frame is an independent frame that enables the first frame to be decoded without reference to a second frame of the bitstream.

Clause 9B. The device of clause 8B being configured to obtain the foreground indication in response to the independent frame indication indicating that the first frame is an independent frame.

Clause 10B. The device of clause 8B further configured to specify, in response to the independent frame indication indicating that the first frame is not an independent frame and in the bitstream, an indication of a type for the transport channel of the second frame.

Clause 11B. The device of clause 10B being configured to obtain the foreground indication for the transport channel of the first frame indicating whether the same transport channel of the second frame included the vector-based audio signal based on the indication of the type for the transport channel of the second frame.

Clause 12B. The device of clause 10B being configured to specify, when a coding mode of a vector corresponding to the foreground audio signal indicates that the vector is a reduced vector, the foreground indication for the transport channel of the first frame in the bitstream, the foreground indication indicating whether the same transport channel of the second frame included the vector-based audio signal based on the indication of the type for the transport channel of the second frame.

Clause 13B. The device of clause 10B being configured to obtain the independent frame indication for the transport channel of the first frame indicating whether the same transport channel of the second frame included the vector-based audio signal when a coding mode of a vector corresponding to the foreground audio signal indicates that the vector is a reduced vector.

Clause 14B. The device of clause 12B or 13B, wherein the vector is decomposed from the HOA audio data.

Clause 15B. The device of any of clauses 1B-14B, wherein the multi-transition indication indicates whether the ambient HOA coefficient is faded-in during the same first frame of the bitstream as the foreground audio signal is faded-in.

Clause 16B. The device of any of clauses 1B-14B, wherein the multi-transition indication indicates whether the ambient HOA coefficient is faded-out during the same first frame of the bitstream as the foreground audio signal is faded-out.

Figure 8:
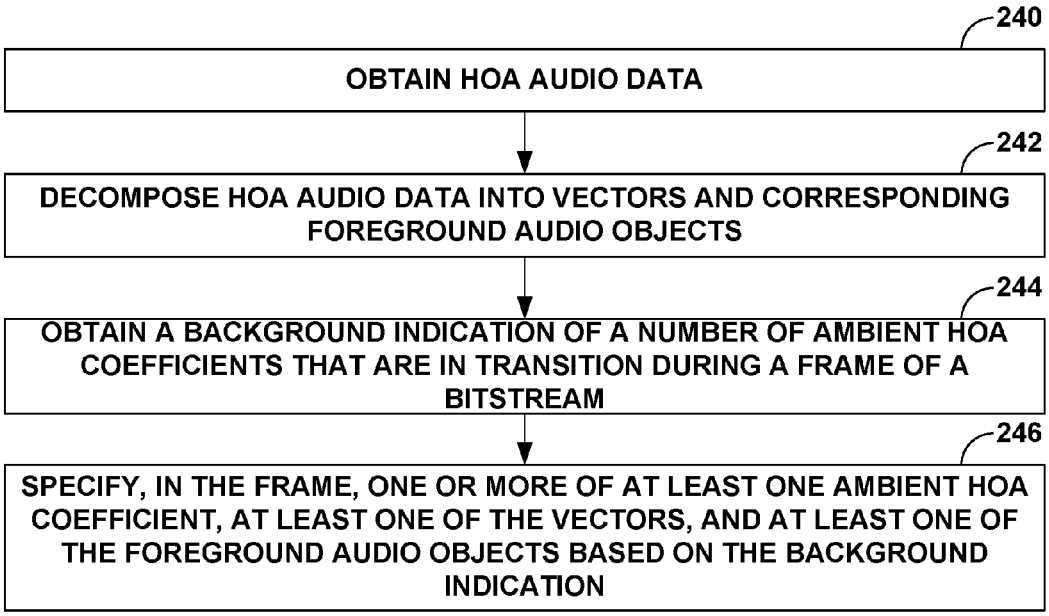

In the example of FIG. 8, the audio encoding device 20 may first obtain HOA audio data (240). The audio encoding device 20 may couple to one or more microphones to capture or otherwise obtain the HOA audio data. The audio encoding device 20 may next decompose the HOA audio data into vectors and corresponding foreground audio objects in the manner described above (242). The audio encoding device 20 may specify the corresponding foreground audio objects in a first frame of the bitstream.

The audio encoding device 20 may also obtain a background indication of a number of ambient HOA coefficients that are in transition during a frame of the bitstream (244). The audio encoding device 20 may specify, in the frame, one or more of at least one ambient HOA coefficient, at least one of the vectors, and at least one of the foreground audio objects based on the background indication (246).

The techniques may enable the audio encoding device 20 configured to perform the aspects of clause 1C shown in FIG. 8 to operate in accordance with the following dependent clauses.

Clause 2C. The device of clause 1C being configured to obtain the background indication in response to an indication indicating that a transition has occurred with respect to one of the ambient HOA coefficients.

Clause 3C. The device of clause 1C being configured to obtain an indication indicating which of the ambient HOA coefficients are in transition during the frame of the bitstream.

Clause 4C. The device of clause 1C further configured to obtain a multi-transition indication of whether an ambient HOA coefficient is in transition during a same frame of the bitstream as a foreground audio signal is in transition based on the background indication.

Clause 5C. The device of clause 1C further configured to obtain a foreground indication of whether a foreground audio signal is in transition during a first frame of the bitstream, the foreground audio signals describing a foreground component of a soundfield represented by the HOA audio data and decomposed from the HOA audio data.

Clause 6C. The device of clause 5C being configured to obtain the foreground indication based on an indication of a type for a transport channel of a second frame of the bitstream.

Clause 7C. The device of clause 5C being configured to obtain, when a coding mode of a vector corresponding to the foreground audio signal indicates that the vector is a reduced vector, the foreground indication based on an indication of a type for a transport channel of a second frame of the bitstream.

Clause 8C. The device of clause 5C further configured to specify, in the first frame of the bitstream, an independent frame indication of whether the first frame is an independent frame that enables the first frame to be decoded without reference to a second frame of the bitstream.

Clause 9C. The device of clause 8C being configured to specify, in the bitstream, the foreground indication in response to the independent frame indication indicating that the first frame is an independent frame.

Clause 10C. The device of clause 8C further configured to obtain, in response to the independent frame indication indicating that the first frame is not an independent frame, an indication of a type for the transport channel of the second frame.

Clause 11C. The device of clause 10C being configured to obtain the foreground indication for the transport channel of the first frame indicating whether the same transport channel of the second frame included the vector-based audio signal based on the indication of the type for the transport channel of the second frame.

Clause 12C. The device of clause 10C being configured to obtain, when a coding mode of a vector corresponding to the foreground audio signal indicates that the vector is a reduced vector, the foreground indication for the transport channel of the first frame indicating whether the same transport channel of the second frame included the vector-based audio signal based on the indication of the type for the transport channel of the second frame.

Clause 13C. The device of clause 10C being configured to obtain the independent frame indication for the transport channel of the first frame indicating whether the same transport channel of the second frame included the vector-based audio signal when a coding mode of a vector corresponding to the foreground audio signal indicates that the vector is a reduced vector.

Clause 14C. The device of clauses 12C and 13C, wherein the vector is decomposed from the HOA audio data.

Clause 15C. The device of clause 1C further configured to obtain a foreground indication of whether a foreground audio signal is in transition during a first frame of the bitstream, the foreground audio signals describing a foreground component of a soundfield represented by the HOA audio data and decomposed from the HOA audio data, and obtain, based on the foreground indication, a multi-transition indication of whether an ambient HOA coefficient is in transition during the same first frame of the bitstream as the foreground audio signal is in transition.

Clause 16C. The device of clause 1C or 15C further configured to obtain, based on the foreground indication, the background indication or both the foreground indication and the background indication, a multi-transition indication of whether an ambient HOA coefficient is in transition during the same first frame of the bitstream as the foreground audio signal is in transition.

Clause 17C. The device of clause 15C or 16C begin configured to obtain the background indication in response to an indication indicating that a transition has occurred with respect to one of the ambient HOA coefficients.

Clause 18C. The device of claim 15C or 16C being configured to obtain an indication indicating which of the ambient HOA coefficients are in transition during the frame of the bitstream.

Clause 19C. The device of clause 16C being configured to obtain, when a coding mode of a vector corresponding to the foreground audio signal indicates that the vector is a reduced vector, the foreground indication based on an indication of a type for a transport channel of a second frame of the bitstream.

Clause 20C. The device of any of clauses 4C-19C, wherein the multi-transition indication indicates whether the ambient HOA coefficient is faded-in during the same first frame of the bitstream as the foreground audio signal is faded-in.

Clause 21C. The device of any of clauses 4C-19C, wherein the multi-transition indication indicates whether the ambient HOA coefficient is faded-out during the same first frame of the bitstream as the foreground audio signal is faded-out.

Clause 22C. The device of any combination of clauses 1C-21C further configured to obtain a vector that describes a spatial characteristic of a corresponding foreground audio signal based on the multi-transition indication, both the vector and the corresponding HOA audio signal decomposed from the HOA audio data.

Figure 9:
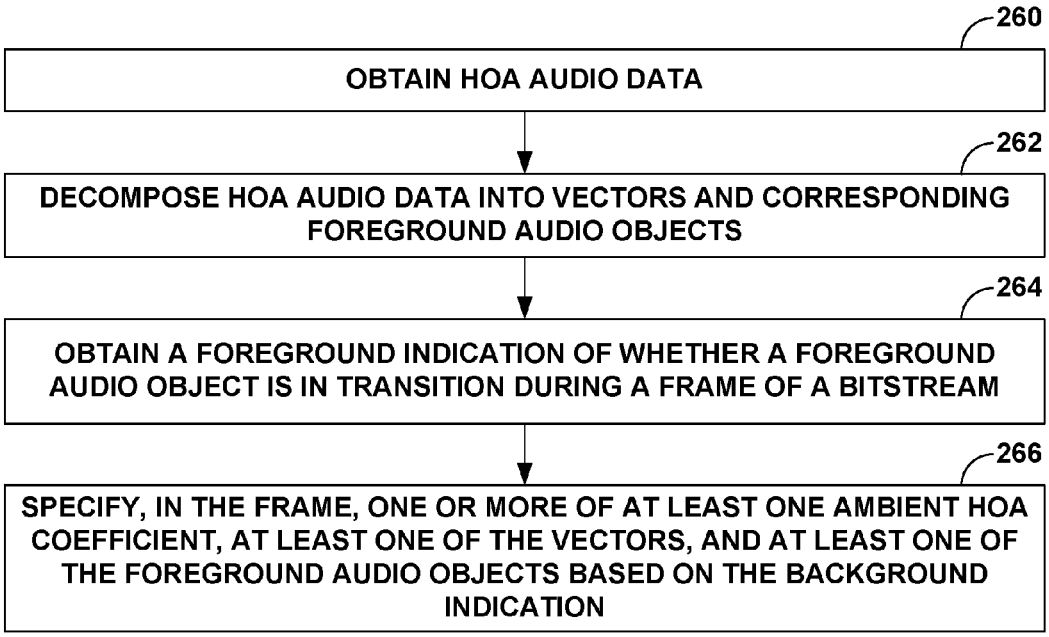

In the example of FIG. 9, the audio encoding device 20 may first obtain HOA audio data (260). The audio encoding device 20 may couple to one or more microphones to capture or otherwise obtain the HOA audio data. The audio encoding device 20 may next decompose the HOA audio data into vectors and corresponding foreground audio objects in the manner described above (262). The audio encoding device 20 may specify the corresponding foreground audio objects in a first frame of the bitstream.

The audio encoding device 20 may also obtain a foreground indication of whether a foreground audio object is in transition during a frame of the bitstream (264). The audio encoding device 20 may specify, in the frame, one or more of at least one ambient HOA coefficient, at least one of the vectors, and at least one of the foreground audio objects based on the foreground indication (266).

The techniques may enable the audio encoding device 20 configured to perform the aspects of clause 1D shown in FIG. 9 to operate in accordance with the following dependent clauses.

Clause 2D. The device of clause 1D being configured to obtain the foreground indication based on an indication of a type for a transport channel of a second frame of the bitstream.

Clause 3D. The device of clause 1D being configured to obtain, when a coding mode of a vector corresponding to the foreground audio signal indicates that the vector is a reduced vector, the foreground indication based on an indication of a type for a transport channel of a second frame of the bitstream.

Clause 4D. The device of clause 1D further configured to specify, in the first frame of the bitstream, an independent frame indication of whether the first frame is an independent frame that enables the first frame to be decoded without reference to a second frame of the bitstream.

Clause 5D. The device of clause 4D being configured to specify, in the bitstream, the foreground indication in response to the independent frame indication indicating that the first frame is an independent frame.

Clause 6D. The device of clause 4D further configured to obtain, in response to the independent frame indication indicating that the first frame is not an independent frame, an indication of a type for the transport channel of the second frame.

Clause 7D. The device of clause 6D being configured to obtain the foreground indication for the transport channel of the first frame indicating whether the same transport channel of the second frame included the vector-based audio signal based on the indication of the type for the transport channel of the second frame.

Clause 8D. The device of clause 6D being configured to obtain, when a coding mode of a vector corresponding to the foreground audio signal indicates that the vector is a reduced vector, the foreground indication for the transport channel of the first frame indicating whether the same transport channel of the second frame included the vector-based audio signal based on the indication of the type for the transport channel of the second frame.

Clause 9D. The device of clause 6D being configured to obtain the independent frame indication for the transport channel of the first frame indicating whether the same transport channel of the second frame included the vector-based audio signal when a coding mode of a vector corresponding to the foreground audio signal indicates that the vector is a reduced vector.

Clause 10D. The device of clause 8D or 9D, wherein the vector is decomposed from the HOA audio data.

Clause 11D. The device of clause 1D further configured to obtain a background indication of a number of ambient HOA coefficients that are in transition during the first frame of the bitstream, the ambient HOA coefficient describing an ambient component of a soundfield represented by the HOA audio data.

Clause 12D. The device of clause 11D being configured to obtain the background indication in response to an indication indicating that a transition has occurred with respect to one of the ambient HOA coefficients.

Clause 13D. The device of clause 11D being configured to obtain an indication indicating which of the ambient HOA coefficients are in transition during the frame of the bitstream.

Clause 14D. The device of clause 1D or 11D further configured to obtain a multi-transition indication of whether the ambient HOA coefficient is in transition during the same first frame of the bitstream as the foreground audio signal is in transition based on the background indication, the foreground indication or both the background indication and the foreground indication.

Clause 15D. The device of clause 14D, wherein the multi-transition indication indicates whether the ambient HOA coefficient is faded-in during the same first frame of the bitstream as the foreground audio signal is faded-in.

Clause 16D. The device of clause 14D, wherein the multi-transition indication indicates whether the ambient HOA coefficient is faded-out during the same first frame of the bitstream as the foreground audio signal is faded-out.

Clause 17D. The device of any combination of clauses 14D-16D are further configured to obtain a vector that describes a spatial characteristic of a corresponding foreground audio signal based on the multi-transition indication, both the vector and the corresponding HOA audio signal decomposed from the HOA audio data.

Figure 10:
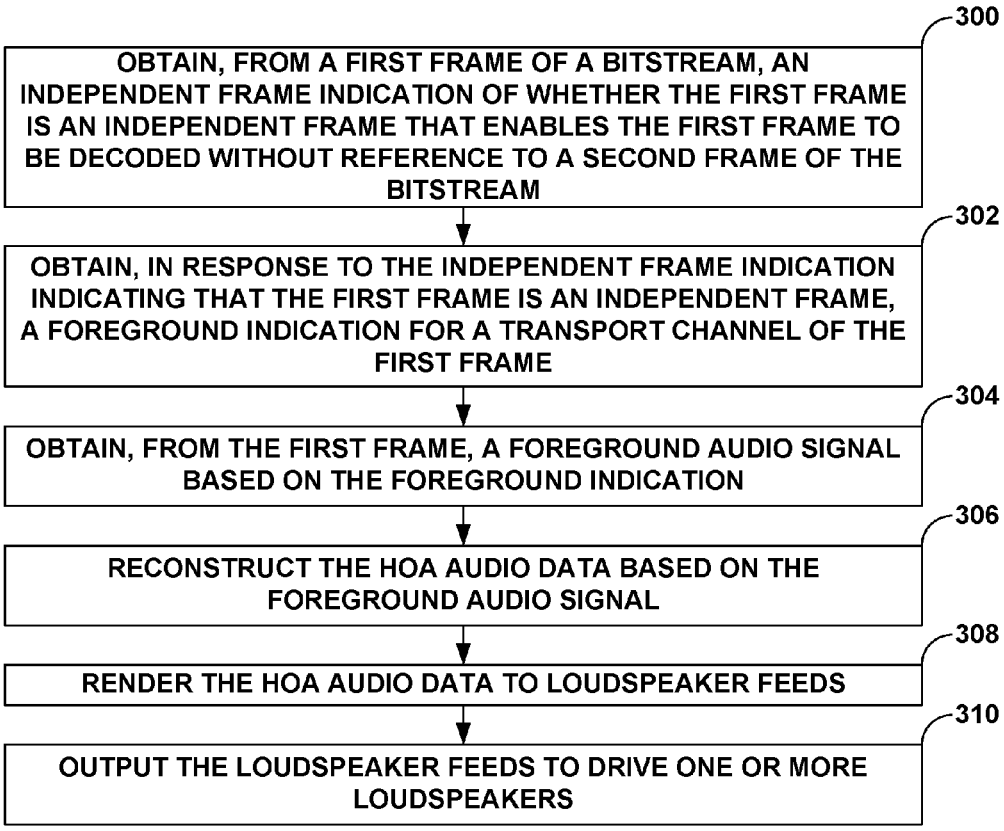
FIGS. 10-13 are flowcharts illustrating example operation of the audio decoding device shown in FIG. 2 in performing various aspects of the techniques described in this disclosure.

FIGS. 10-13 are flowcharts illustrating example operation of the audio decoding device 24 in performing various aspects of the techniques described in this disclosure. In the example of FIG. 10, the audio decoding device 24 may obtain, from a first frame of a bitstream, an independent frame indication of whether the first frame is an independent frame that enables the first frame to be decoded without reference to a second frame of the bitstream (300). The audio decoding device 24 may also obtain, in response to the independent frame indication indicating that the first frame is an independent frame, a foreground indication for a transport channel of the first frame (302). As described above, the foreground indication may indicate whether the same transport channel of the second frame includes a foreground audio signal decomposed from the higher-order ambisonic audio data.

The audio decoding device 24 may next obtain, from the first frame, a foreground audio signal based on the foreground indication (which, as described above, may be decomposed from the HOA audio data) (304). The audio decoding device 24 may reconstruct the HOA audio data based on the foreground audio signal, render the HOA audio data to loudspeaker feeds, and output the loudspeaker feeds to drive one or more loudspeakers (306-310). The audio decoding device 24 may include or otherwise couple to the loudspeakers.

The techniques may enable the audio decoding device 24 configured to perform the aspects of clause 1AA shown in FIG. 10 to operate in accordance with the following dependent clauses.

Clause 2AA. The device of clause 1AA further configured to obtain, in response to the independent frame indication indicating that the first frame is not an independent frame, an indication of a type for the transport channel of the second frame.

Clause 3AA. The device of clause 2AA being configured to obtain the foreground indication for the transport channel of the first frame indicating whether the same transport channel of the second frame included the vector-based audio signal based on the indication of the type for the transport channel of the second frame.

Clause 4AA. The device of clause 2AA being configured to obtain, when a coding mode of a vector corresponding to the foreground audio signal indicates that the vector is a reduced vector, the foreground indication for the transport channel of the first frame indicating whether the same transport channel of the second frame included the vector-based audio signal based on the indication of the type for the transport channel of the second frame.

Clause 5AA. The device of clause 1AA being configured to obtain the independent frame indication for the transport channel of the first frame indicating whether the same transport channel of the second frame included the vector-based audio signal when a coding mode of a vector corresponding to the foreground audio signal indicates that the vector is a reduced vector.

Clause 6AA. The device of clause 4AA and 5AA, wherein the vector is decomposed from the HOA audio data.

Clause 7AA. The device of claim 1AA further configured to obtain a background indication of a number of ambient HOA coefficients that are in transition during the first frame of the bitstream, and obtain, based on the background indication, a multi-transition indication of whether an ambient HOA coefficient is in transition during the same first frame of the bitstream as the foreground audio signal is in transition.

Clause 8AA. The device of clause 1AA or 7AA further configured to obtain, based on the foreground indication, the background indication or both the foreground indication and the background indication, a multi-transition indication of whether an ambient HOA coefficient is in transition during the same first frame of the bitstream as the foreground audio signal is in transition.

Clause 9A. The device of clause 7AA or 8AA being configured to obtain the background indication in response to an indication indicating that a transition has occurred with respect to one of the ambient HOA coefficients.

Clause 10AA. The device of clause 7AA or 8AA being configured to obtain an indication indicating which of the ambient HOA coefficients are in transition during the frame of the bitstream.

Clause 11AA. The device of clause 8AA being configured to obtain, when a coding mode of a vector corresponding to the foreground audio signal indicates that the vector is a reduced vector, the foreground indication based on an indication of a type for a transport channel of a second frame of the bitstream.

Clause 12AA. The device of any combination of clauses 7AA-11AA, wherein the multi-transition indication indicates whether the ambient HOA coefficient is faded-out during the same first frame of the bitstream as the foreground audio signal is faded-in.

Clause 13AA. The device of any combination of clauses 7AA-11AA, wherein the multi-transition indication indicates whether the ambient HOA coefficient is faded-out during the same first frame of the bitstream as the foreground audio signal is faded-out.

Clause 14AA. The device of any combination of clauses 7AA-13AA further configured to obtain a vector that describes a spatial characteristic of a corresponding foreground audio signal based on the multi-transition indication, both the vector and the corresponding HOA audio signal decomposed from the HOA audio data.

Figure 11:
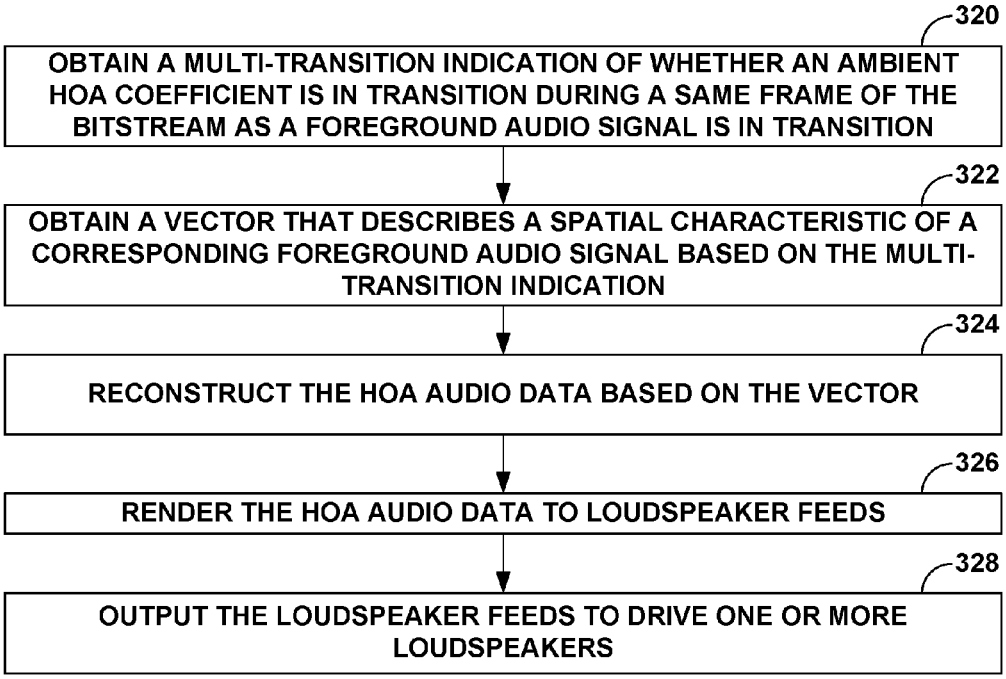

In the example of FIG. 11, the audio decoding device 24 may obtain a multi-transition indication of whether an ambient HOA coefficient is in transition during a same frame of the bitstream as a foreground audio signal is in transition (320). The audio decoding device 24 may also obtain a vector that describes a spatial characteristic of a corresponding foreground audio signal based on the multi-transition indication (322). As described above, both the vector and the corresponding HOA audio signal may be decomposed from the HOA audio data.

The audio decoding device 24 may reconstruct the HOA audio data based on the vector, render the HOA audio data to loudspeaker feeds, and output the loudspeaker feeds to drive one or more loudspeakers (324-328). The audio decoding device 24 may include or otherwise couple to the loudspeakers.

The techniques may enable the audio decoding device 24 configured to perform the aspects of clause 1BB shown in FIG. 11 to operate in accordance with the following dependent clauses.

Clause 2BB. The device of clause 1BB further configured to obtain a background indication of a number of ambient HOA coefficients that are in transition during the first frame of the bitstream, and being configured to obtain the multi-transition indication based on the background indication.

Clause 3BB. The device of clause 1BB, further configured to obtain a foreground indication of whether a foreground audio signal is in transition during a frame of the bitstream, and being configured to obtain the multi-transition indication based on the foreground indication.

Clause 4BB. The device of clause 1BB further configured to obtain a background indication of a number of ambient HOA coefficients that are in transition during a frame of the bitstream, and obtain a foreground indication of whether a foreground audio signal is in transition during a frame of the bitstream, and being configured to obtain the multi-transition indication based on the foreground indication and the background indication.

Clause 5BB. The device of clause 2BB or 4BB being configured to obtain the background indication in response to an indication indicating that a transition has occurred with respect to one of the ambient HOA coefficients.

Clause 6BB. The device of clause 2BB or 4BB being configured to obtain an indication indicating which of the ambient HOA coefficients are in transition during the frame of the bitstream.

Clause 7BB. The device of clause 3BB or 4BB being configured to obtain, when a coding mode of a vector corresponding to the foreground audio signal indicates that the vector is a reduced vector, the foreground indication based on an indication of a type for a transport channel of a second frame of the bitstream.

Clause 8BB. The device of clause 3BB or 4BB further configured to obtain, from the first frame of the bitstream, an independent frame indication of whether the first frame is an independent frame that enables the first frame to be decoded without reference to a second frame of the bitstream.

Clause 9BB. The device of clause 8BB being configured to obtain, from the bitstream, the foreground indication in response to the independent frame indication indicating that the first frame is an independent frame.

Clause 10BB. The device of clause 8BB further configured to obtain, in response to the independent frame indication indicating that the first frame is not an independent frame, an indication of a type for the transport channel of the second frame.

Clause 11BB. The device of clause 10BB being configured to obtain the foreground indication for the transport channel of the first frame indicating whether the same transport channel of the second frame included the vector-based audio signal based on the indication of the type for the transport channel of the second frame.

Clause 12BB. The device of clause 10BB being configured to obtain, when a coding mode of a vector corresponding to the foreground audio signal indicates that the vector is a reduced vector, the foreground indication for the transport channel of the first frame indicating whether the same transport channel of the second frame included the vector-based audio signal based on the indication of the type for the transport channel of the second frame.

Clause 13B. The device of clause 10BB being configured to obtain the independent frame indication for the transport channel of the first frame indicating whether the same transport channel of the second frame included the vector-based audio signal when a coding mode of a vector corresponding to the foreground audio signal indicates that the vector is a reduced vector.

Clause 14BB. The device of clause 12BB or 13BB, wherein the vector is decomposed from the HOA audio data.

Clause 15BB. The device of any combination of clauses 1BB-14BB, wherein the multi-transition indication indicates whether the ambient HOA coefficient is faded-in during the same first frame of the bitstream as the foreground audio signal is faded-in.

Clause 16BB. The device of any combination of clauses 1BB-14BB, wherein the multi-transition indication indicates whether the ambient HOA coefficient is faded-out during the same first frame of the bitstream as the foreground audio signal is faded-out.

Figure 12:
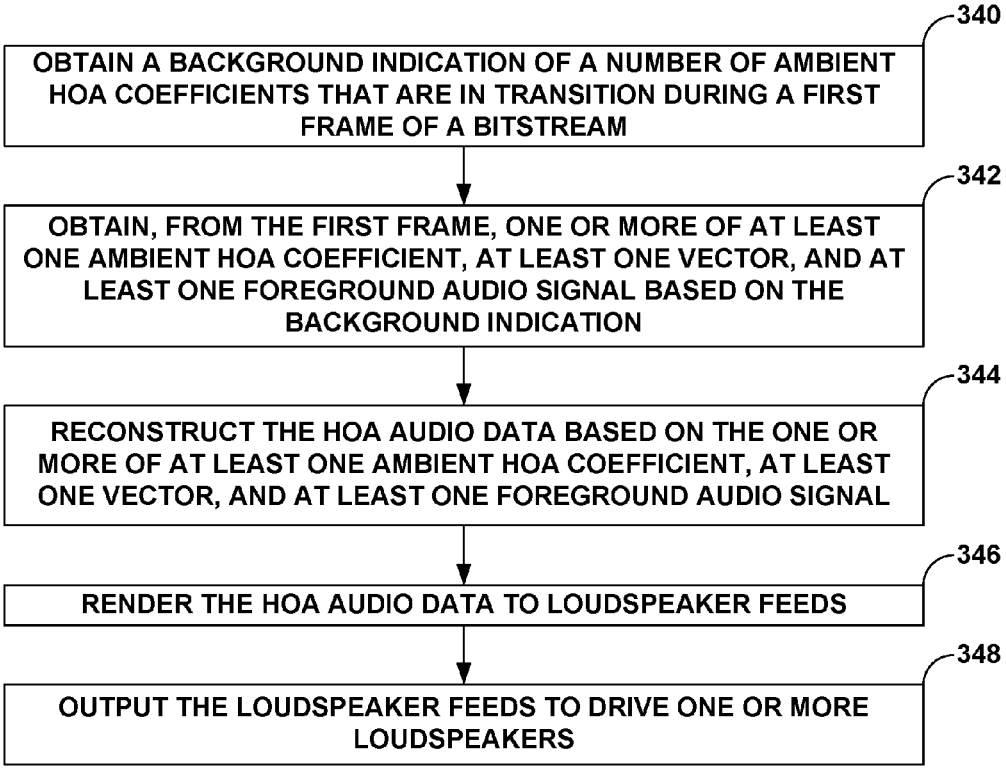

In the example of FIG. 12, the audio decoding device 24 may obtain a background indication of a number of ambient HOA coefficients that are in transition during a first frame of a bitstream (340). As described above, the ambient HOA coefficient may describe an ambient component of a soundfield represented by the HOA audio data. The audio decoding device 24 may obtain, from the first frame, one or more of at least one ambient HOA coefficient, at least one vector, and at least one foreground audio signal based on the background indication (342).

Based on the one or more of at least one ambient HOA coefficient, the at least one vector, and the at least one foreground audio signal, the audio decoding device 24 may reconstruct HOA audio data (344). The audio decoding device 24 may render the HOA audio data to loudspeaker feeds, and output the loudspeaker feeds to drive one or more loudspeakers (346, 348). Again, the audio decoding device 24 may include or otherwise couple to the loudspeakers.

The techniques may enable the audio decoding device 24 configured to perform the aspects of clause 1CC shown in FIG. 12 to operate in accordance with the following dependent clauses.

Clause 2CC. The device of clause 1CC being configured to obtain the background indication in response to an indication indicating that a transition has occurred with respect to one of the ambient HOA coefficients.

Clause 3CC. The device of clause 1CC being configured to obtain an indication indicating which of the ambient HOA coefficients are in transition during the frame of the bitstream.

Clause 4CC. The device of clause 1CC further configured to obtain a multi-transition indication of whether an ambient HOA coefficient is in transition during a same frame of the bitstream as a foreground audio signal is in transition based on the background indication.

Clause 5CC. The device of clause 1CC further configured to obtain a foreground indication of whether a foreground audio signal is in transition during a first frame of the bitstream, the foreground audio signals describing a foreground component of a soundfield represented by the HOA audio data and decomposed from the HOA audio data.

Clause 6CC. The device of clause 5CC being configured to obtain the foreground indication based on an indication of a type for a transport channel of a second frame of the bitstream.

Clause 7CC. The device of clause 5CC being configured to obtain, when a coding mode of a vector corresponding to the foreground audio signal indicates that the vector is a reduced vector, the foreground indication based on an indication of a type for a transport channel of a second frame of the bitstream.

Clause 8CC. The device of clause 5CC further configured to obtain, from the first frame of the bitstream, an independent frame indication of whether the first frame is an independent frame that enables the first frame to be decoded without reference to a second frame of the bitstream.

Clause 9CC. The device of clause 8CC being configured to obtain, from the bitstream, the foreground indication in response to the independent frame indication indicating that the first frame is an independent frame.

Clause 10CC. The device of clause 8CC further configured to obtain, in response to the independent frame indication indicating that the first frame is not an independent frame, an indication of a type for the transport channel of the second frame.

Clause 11CC. The device of clause 10CC being configured to obtain the foreground indication for the transport channel of the first frame indicating whether the same transport channel of the second frame included the vector-based audio signal based on the indication of the type for the transport channel of the second frame.

Clause 12CC. The device of clause 10CC being obtain, when a coding mode of a vector corresponding to the foreground audio signal indicates that the vector is a reduced vector, the foreground indication for the transport channel of the first frame indicating whether the same transport channel of the second frame included the vector-based audio signal based on the indication of the type for the transport channel of the second frame.

Clause 13CC. The device of clause 10CC being configured to obtain the independent frame indication for the transport channel of the first frame indicating whether the same transport channel of the second frame included the vector-based audio signal when a coding mode of a vector corresponding to the foreground audio signal indicates that the vector is a reduced vector.

Clause 14CC. The device of clause 12CC or 13CC, wherein the vector is decomposed from the HOA audio data.

Clause 15CC. The device of clause 1CC further configured to obtain a foreground indication of whether a foreground audio signal is in transition during a first frame of the bitstream, the foreground audio signals describing a foreground component of a soundfield represented by the HOA audio data and decomposed from the HOA audio data, and obtain, based on the foreground indication, a multi-transition indication of whether an ambient HOA coefficient is in transition during the same first frame of the bitstream as the foreground audio signal is in transition.

Clause 16CC. The device of clause 1CC or 15CC further configured to obtain, based on the foreground indication, the background indication or both the foreground indication and the background indication, a multi-transition indication of whether an ambient HOA coefficient is in transition during the same first frame of the bitstream as the foreground audio signal is in transition.

Clause 17CC. The device of clause 15CC or 16CC being configured to obtain the background indication in response to an indication indicating that a transition has occurred with respect to one of the ambient HOA coefficients.

Clause 18CC. The device of clause 15CC or 16CC being configured to obtain an indication indicating which of the ambient HOA coefficients are in transition during the frame of the bitstream.

Clause 19CC. The device of clause 16CC being configured to obtain, when a coding mode of a vector corresponding to the foreground audio signal indicates that the vector is a reduced vector, the foreground indication based on an indication of a type for a transport channel of a second frame of the bitstream.

Clause 20CC. The device of any combination of clauses 4CC-19CC, wherein the multi-transition indication indicates whether the ambient HOA coefficient is faded-in during the same first frame of the bitstream as the foreground audio signal is faded-in.

Clause 21CC. The device of any combination of clauses 4CC-19CC, wherein the multi-transition indication indicates whether the ambient HOA coefficient is faded-out during the same first frame of the bitstream as the foreground audio signal is faded-out.

Clause 22CC. The device of any combination of clauses 1CC-21CC further configured to obtain a vector that describes a spatial characteristic of a corresponding foreground audio signal based on the multi-transition indication, both the vector and the corresponding HOA audio signal decomposed from the HOA audio data.

Figure 13:
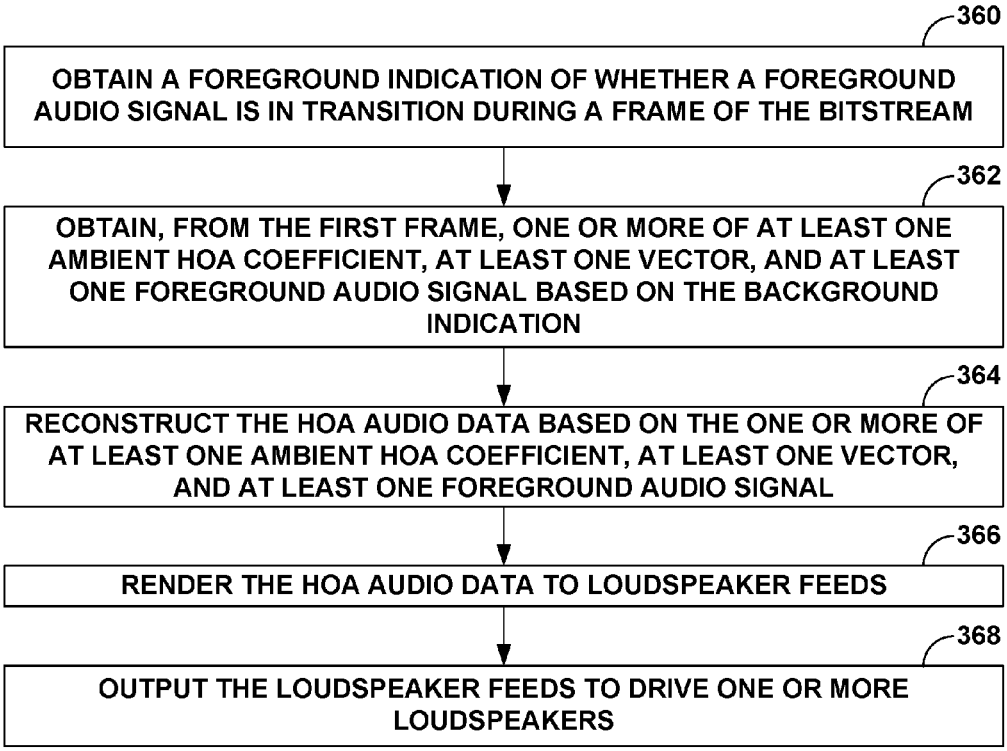

In the example of FIG. 13, the audio decoding device 24 may also obtain a foreground indication of whether a foreground audio signal is in transition during a frame of the bitstream (360). The audio decoding device 24 may obtain, from the frame, one or more of at least one ambient HOA coefficients, at least one of the vectors, and at least one of the foreground audio objects based on the foreground indication (362).

Based on the one or more of at least one ambient HOA coefficient, the at least one vector, and the at least one foreground audio signal, the audio decoding device 24 may reconstruct HOA audio data (364). The audio decoding device 24 may render the HOA audio data to loudspeaker feeds, and output the loudspeaker feeds to drive one or more loudspeakers (366, 368). Again, the audio decoding device 24 may include or otherwise couple to the loudspeakers.

The techniques may enable the audio decoding device 24 configured to perform the aspects of clause 1DD shown in FIG. 13 to operate in accordance with the following dependent clauses.

Clause 2DD. The device of clause 1DD being configured to obtain the foreground indication based on an indication of a type for a transport channel of a second frame of the bitstream.

Clause 3DD. The device of clause 1DD being configured to obtain, when a coding mode of a vector corresponding to the foreground audio signal indicates that the vector is a reduced vector, the foreground indication based on an indication of a type for a transport channel of a second frame of the bitstream.

Clause 4DD. The device of clause 1DD further configured to obtain, from the first frame of the bitstream, an independent frame indication of whether the first frame is an independent frame that enables the first frame to be decoded without reference to a second frame of the bitstream.

Clause 5DD. The device of clause 4DD being configured to obtain, from the bitstream, the foreground indication in response to the independent frame indication indicating that the first frame is an independent frame.

Clause 6DD. The device of clause 4DD further configured to obtain, in response to the independent frame indication indicating that the first frame is not an independent frame, an indication of a type for the transport channel of the second frame.

Clause 7DD. The device of clause 6DD being configured to obtain the foreground indication for the transport channel of the first frame indicating whether the same transport channel of the second frame included the vector-based audio signal based on the indication of the type for the transport channel of the second frame.

Clause 8DD. The device of clause 6DD being configured to obtain, when a coding mode of a vector corresponding to the foreground audio signal indicates that the vector is a reduced vector, the foreground indication for the transport channel of the first frame indicating whether the same transport channel of the second frame included the vector-based audio signal based on the indication of the type for the transport channel of the second frame.

Clause 9DD. The device of clause 6DD being configured to obtain the independent frame indication for the transport channel of the first frame indicating whether the same transport channel of the second frame included the vector-based audio signal when a coding mode of a vector corresponding to the foreground audio signal indicates that the vector is a reduced vector.

Clause 10DD. The device of clause 8DD or 9DD, wherein the vector is decomposed from the HOA audio data.

Clause 11DD. The device of clause 1DD further configured to obtain a background indication of a number of ambient HOA coefficients that are in transition during the first frame of the bitstream, the ambient HOA coefficient describing an ambient component of a soundfield represented by the HOA audio data.

Clause 12DD. The device of clause 11DD being configured to obtain the background indication in response to an indication indicating that a transition has occurred with respect to one of the ambient HOA coefficients.

Clause 13DD. The device of clause 11DD being configured to obtain an indication indicating which of the ambient HOA coefficients are in transition during the frame of the bitstream.

Clause 14DD. The device of clause 1DD or 11DD further configured to obtain a multi-transition indication of whether the ambient HOA coefficient is in transition during the same first frame of the bitstream as the foreground audio signal is in transition based on the background indication, the foreground indication or both the background indication and the foreground indication.

Clause 15DD. The device of clause 14DD, wherein the multi-transition indication indicates whether the ambient HOA coefficient is faded-in during the same first frame of the bitstream as the foreground audio signal is faded-in.

Clause 16DD. The device of clause 14DD, wherein the multi-transition indication indicates whether the ambient HOA coefficient is faded-out during the same first frame of the bitstream as the foreground audio signal is faded-out.

Clause 17DD. The device of any combination of clauses 14DD-16DD further configured to obtain a vector that describes a spatial characteristic of a corresponding foreground audio signal based on the multi-transition indication, both the vector and the corresponding HOA audio signal decomposed from the HOA audio data.

Additional aspects of the techniques may be directed to the following items with various tables and section numbers referencing phase I or II of the above noted 3D audio coding standard. Underlined italics items below denote additions to phase I or II of the above noted 3D audio coding standard.

HOA Matrix Encoder/Decoder

For signaling a HOA rendering matrix in the bitstream, the HOA rendering matrix is quantized with accuracy up to 0.125 dB per weighting value. However, if the desired rendering matrix has been purposely designed to be energy normalized, this quantization noise causes the decoded HOA rendering matrix to be not energy normalized anymore. Thus, we propose an option to renormalize the dequantized rendering matrix to its original energy-normalized state.

In Table 23—Syntax of HOARenderingMatrix( ) replace:

| | | |
|---|---|---|
| precisionLevel | 2 | uimsbf |
| if (gainLimitPerHoaOrder) { | 1 | uimsbf |

with:

| | | |
|---|---|---|
| precisionLevel | 2 | uimsbf |
| *isNormalized* | *1* | *uimsbf* |
| if (gainLimitPerHoaOrder) { | 1 | uimsbf |

In subclause 5.3.6 HOA Rendering Matrix Data Elements add before precisionLevel:

| | |
|---|---|
| isNormalized | Indicates if the HOA rendering matrix D is energy normalized, so that $\|\|D\|\|_f = \Sigma_{l=1}^{L} \Sigma_{n=1}^{(N+1)2} D_{l,n}^{2} = 1$ with l being the non-LFE loudspeakers in the outputConfig. |

In Table 24 5.4.3.3 Decoding of HOA Rendering Matrix Coefficients after:

In this case the code words to decode the individual matrix elements for the left loudspeaker are reduced or completely omitted accordingly.

Add:

If the bitfield isNormalized was set to 1 the final HOA rendering matrix D is created by dividing each weighting value in the L rows of the HOA rendering matrix that are associated with non-LFE loudspeakers by the matrix's Frobenius Norm $\Sigma_{l=1}^{L}\Sigma_{n=1}^{(N+1)^2} D_{l,n}^{2}$ computed from its L rows associated with non-LFE loudspeakers.

In subclause 12.4.1.10.2 replace:

The size of the Vector codebook depends on the value NumVvecIndices and on the HOA order. If the variable NumVvecIndices is set to 1, the vector codebook containing HOA expansion coefficients derived from Annex F is used. If NumVvecIndices is larger than 1, the Vector codebook with O vector is used in combination with 256×8 weighting values (Table in Annex F.12). For the HOA order 4, the Vector codebook with 32 entries as derived from the Table in Annex F.6 is used.

With:

The size of the Vector codebook depends on the value CodebkIdx(k)[i], on the value NumVvecIndices(k)[i] and on the HOA order. If NumVvecIndices is larger than 1, the 256×8 weighting values (Table in Annex F.12) are used. If NumVvecIndices is larger than 8, the last 2 columns of the 256×8 weighting values (Table in Annex F.12) are used repeatedly with a modular operator.

If the CodebkIdx(k)[i] is set to 0, a codebook containing the HOA expansion coefficients derived from Annex F is used.

If the CodebkIdx(k)[i] is set to 1 the V-vector codebook is generated based on the loudspeaker positions ($2^{nd}$ and $3^{rd}$ column) in Table 94 and used with scaling. If the CodebkIdx (k)[i] is set to 2, the V-vector codebook based on the loudspeaker positions $2^{nd}$ and $3^{rd}$ column) in Table 94 is generated and used without further scaling.

If the CodebkIdx(k)[i] is set to 7, a vector with O vectors is used. For the HOA order 4, the Vector codebook with 32 entries as derived from the Table in Annex F.6 is used.

In subclause 12.4.1.10.2 replace:

```
case 1:
        VVecLength = NumOfHoaCoeffs − MinNumOfCoeffsForAmbHOA − NumOfContAddHoaChans;
        CoeffIdx = MinNumOfCoeffsForAmbHOA+1;
        for (m=0; m<VVecLength; ++m) {
            bIsInArray = isMemberOf(CoeffIdx, ContAddHoaCoeff, NumOfContAddHoaChans);
            while (bIsInArray) {
                CoeffIdx++;
                bIsInArray = isMemberOf(CoeffIdx, ContAddHoaCoeff, NumOfContAddHoaChans);
            }
            VVecCoeffId[m] = CoeffIdx−1;
        }
        break;
With:
case 1:
VVecLength[i] = NumOfHoaCoeffs − MinNumOfCoeffsForAmbHOA − NumOfContAddHoaChans −(NewChannelTypeOne[i]* NumOfNewAddHoaChans);
        CoeffIdx = MinNumOfCoeffsForAmbHOA+1;
        for (m=0; m<VVecLength; ++m) {
            if(NewChannelTypeOne[i]) {
                bIsInArray = ( isMemberOf(CoeffIdx, ContAddHoaCoeff, NumOfContAddHoaChans) ||isMemberOf(CoeffIdx, NewAddHoaChans, NumOfNewAddHoaChans) );
                while (bIsInArray) {
                    CoeffIdx++;
                    bIsInArray = ( (isMemberOf(CoeffIdx, ContAddHoaCoeff, NumOfContAddHoaChans) ||isMemberOf(CoeffIdx, NewAddHoaChans, NumOfNewAddHoaChans) );
                }
            }else {
                bIsInArray = isMemberOf(CoeffIdx, ContAddHoaCoeff, NumOfContAddHoaChans)
                while (bIsInArray) {
                    CoeffIdx++;
                    bIsInArray = isMemberOf(CoeffIdx, ContAddHoaCoeff, NumOfContAddHoaChans);
                }
            }
            VVecCoeffId[m] = CoeffIdx−1;
        }
        break;
```

In subclause 12.4.1.10.5 Conversion of VVec elements replace:

```
if (NbitsQ(k)[i] == 4) {
    if (NumVvecIndices == 1) {
        for (m=0; m< VVecLength; ++m)
            idx = VVecCoeffID[m];
            v^(i)_VVecCoeffId[m](k) = WeightVal[0] * VecDict[900].[VvecIdx[0]][idx];
        }
} else {
        cdbLen = O;
        if (N==4) {
            cdbLen = 32;
        }
        for (m=0; m<O; ++m) {
            TmpVVec[m] = 0;
            for (j=0; j< NumVvecIndices; ++j) {
                TmpVVec[m] += WeightVal[j] * VecDict[cdbLen].[VvecIdx[j]][m];
            }
        }
        FNorm = 0.0;
        for (m=0; m<O; ++m) {
            FNorm += TmpVVec[m] * TmpVVec[m];
        }
```

-continued

```
        FNorm = (N+1)/sqrt(FNorm);
        for (m=0; m< VVecLength; ++m) {
                idx = VVecCoeffID[m];
                v^(i)_VVecCoeffId[m](k)= TmpVVec[idx] * FNorm;
        }
    }
}
        With:
        if (NbitsQ(k)[i] == 4) {
        for (m=0; m< O; ++m) {
                TmpVVec[m] = 0;
                for (j=0; j< NumVvecIndices(k)[i]; ++j) {
        TmpVVec[m]+=WeightVal[j]*VecDict[CodebkIdx].[VvecIdx[j]][m];
                }
            }
        if (doScaling) {
                FNorm = 0.0;
                for (m=0; m<O; ++m) {
                    FNorm += TmpVVec[m] * TmpVVec[m];
                }
                for (m=0; m< VVecLength; ++m) {
                    idx = VVecCoeffID[m];
                    v^(i)_VVecCoeffId[m](k)= TmpVVec[idx] *
(N+1)/sqrt(FNorm);
            }
            }
        }
```

In subclause 12.4.1.10.5 Conversion of VVec elements replace:

```
if (PFlag(k)[i] == 1) {
        v^(i)_VVecCoeffId[m](k) += v^(i)_VVecCoeffId[m](k − 1);
    }
    with:
if (PFlag(k)[i] == 1) {
        v^(i)_VVecCoeffId[m](k) += floor(0.5 +v^(i)_VVecCoeffId[m](k −1) * 2^14)*
2^−14;
    }
```

Add before subclause 12.4.1.10.6 Tuple set $\mathcal{M}_{VEC}$(k):

```
        selectCodebk
        switch CodebkIdx {
            case 0:
                cdbLen = 900;
                nbitsIdx = 10;
            doScaling = 1;
                break;
            case 1:
                cdbLen = 43;
                nbitsIdx = 6;
            doScaling = 1;
                break;
            case2:
                cdbLen = 43;
                nbitsIdx = 6;
            doScaling = 0;
                break;
            case 3
                /* reserved */
            case 4
                /* reserved */
            case 5
                /* reserved */
            case 6
                /* reserved */
                break;
            case 7:
                cdbLen = (N+1)*(N+1);
                if (N==4){
                    cdbLen = 32;
            }
```

-continued

```
                nbitsIdx = ceil(log2(NumOfHoaCoeffs));
            doScaling = 1;
        }
        REMOVE ME?
```

Add as Annex F.XXX34 distributed Positions in Spherical Coordinates

| Index | θ in deg | ϕ in deg |
|---|---|---|
| 1 | 30 | 90 |
| 2 | −30 | 90 |
| 3 | 0 | 90 |
| 4 | 110 | 90 |
| 5 | −110 | 90 |
| 6 | 22 | 90 |
| 7 | −22 | 90 |
| 8 | 135 | 90 |
| 9 | −135 | 90 |
| 10 | 180 | 90 |
| 11 | 90 | 90 |
| 12 | −90 | 90 |
| 13 | 60 | 90 |
| 14 | −60 | 90 |
| 15 | 30 | 55 |
| 16 | −30 | 55 |
| 17 | 0 | 55 |
| 18 | 135 | 55 |
| 19 | −135 | 55 |
| 20 | 180 | 55 |
| 21 | 90 | 55 |
| 22 | −90 | 55 |
| 23 | 0 | 0 |
| 24 | 45 | 105 |
| 25 | −45 | 105 |
| 26 | 0 | 105 |
| 27 | 110 | 55 |
| 28 | −110 | 55 |
| 29 | 45 | 55 |
| 30 | −45 | 55 |
| 31 | 45 | 90 |

-continued

| Index | θ in deg | φ in deg |
|---|---|---|
| 32 | −45 | 90 |
| 33 | 150 | 90 |
| 34 | −150 | 90 |

In subclause 12.4.2.4.4.2 Spatio-temporal interpolation of V-vectors replace:

If there are coefficient sequences of the ambient HOA component that are explicitly additionally transmitted and faded in during the k-th frame (of which the indices are contained in the set $\mathcal{I}_E$ (k)), the respective coefficient sequences of the HOA representation $\tilde{C}_{VEC}$(k) have to be faded out using the fade-out part of the window $W_{DIR}$.

With:

If there are coefficient sequences of the ambient HOA component that are explicitly additionally transmitted and faded in during the k-th frame (of which the indices are contained in the set $\mathcal{I}_E$(k)), the respective coefficient sequences of the HOA representation $\tilde{C}_{VEC}$(k) have to be faded out using the fade-out part of the window $W_{DIR}$. The respective v-vector elements in $v_I^{(i)}$(k) are discarded from the spatio-temporal interpolation in the following frame k+1 by setting them to zero.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is described above as performing. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A device configured to decode a bitstream representative of higher-order ambisonic (HOA) audio data, the device comprising:

one or more processors configured to:

obtain a multi-transition indication of whether an ambient HOA coefficient is in transition during a same frame of the bitstream as a foreground audio signal is in transition; and obtain a vector that describes a spatial characteristic of a corresponding foreground audio signal based on the multi-transition indication, the vector defined in a spherical harmonic domain;

render, based on the vector, one or more speaker feeds; and output the one or more speaker feeds to one or more speakers; and a memory coupled to the one or more processors, and configured to store the vector.

2. The device of claim 1, wherein the one or more processors are further configured to obtain a background indication of a number of ambient HOA coefficients that are in transition during the frame of the bitstream, and wherein the one or more processors are configured to obtain the multi-transition indication based on the background indication.

3. The device of claim 2, wherein the one or more processors are configured to obtain the background indication in response to an indication indicating that a transition has occurred with respect to one of the ambient HOA coefficients.

4. The device of claim 2, wherein the one or more processors are configured to obtain an indication indicating which of the ambient HOA coefficients are in transition during the frame of the bitstream.

5. The device of claim 1, wherein the one or more processors are further configured to obtain a foreground indication of whether a foreground audio signal is in transition during the frame of the bitstream, and wherein the one or more processors are configured to obtain the multi-transition indication based on the foreground indication.

6. The device of claim 1, wherein the multi-transition indication indicates whether the ambient HOA coefficient is faded-in during the same frame of the bitstream as the foreground audio signal is faded-in.

7. The device of claim 1, wherein the multi-transition indication indicates whether the ambient HOA coefficient is faded-out during the same frame of the bitstream as the foreground audio signal is faded-out.

8. The device of claim 1, wherein the device comprises a television, the television including the one or more speakers as one or more integrated speakers.

9. The device of claim 1, wherein the device comprises a receiver, the receiver coupled to the one or more speakers.

10. A method of decoding a bitstream representative of higher-order ambisonic (HOA) audio data, the method comprising:

obtaining, by one or more processors, a multi-transition indication of whether an ambient HOA coefficient is in transition during a same frame of the bitstream as a foreground audio signal is in transition; and obtaining, by the one or more processors, a vector that describes a spatial characteristic of a corresponding foreground audio signal based on the multi-transition indication, both the vector defined in a spherical harmonic domain;

rendering, by the one or more processors and based on the vector, one or more speaker feeds; and outputting, by the one or more processors, the one or more speaker feeds to one or more speakers.

11. The method of claim 10, further comprising:

obtaining a background indication of a number of ambient HOA coefficients that are in transition during the frame of the bitstream; and obtaining a foreground indication of whether a foreground audio signal is in transition during the frame of the bitstream, wherein obtaining the multi-transition indication comprises obtaining the multi-transition indication based on the foreground indication and the background indication.

12. The method of claim 11, wherein obtaining the background indication comprises obtaining the background indication in response to an indication indicating that a transition has occurred with respect to one of the ambient HOA coefficients.

13. The method of claim 11, further comprising obtaining an indication indicating which of the ambient HOA coefficients are in transition during the frame of the bitstream.

14. The method of claim 11, wherein obtaining the foreground indication comprises obtaining, when a coding mode of the vector corresponding to the foreground audio signal indicates that the vector is a reduced vector, the foreground indication based on an indication of a type for a transport channel of a different frame of the bitstream.

15. The method of claim 11, further comprising obtaining, from the frame of the bitstream, an independent frame indication of whether the first frame is an independent frame that enables the frame to be decoded without reference to a different frame of the bitstream.

16. The method of claim 15, wherein obtaining the foreground indication comprises obtaining, from the bitstream, the foreground indication in response to the independent frame indication indicating that the first frame is an independent frame.

17. The method of claim 15, further comprising obtaining, in response to the independent frame indication indicating that the first frame is not an independent frame, an indication of a type for the transport channel of the different frame.

18. The method of claim 17, wherein obtaining the foreground indication comprises obtaining the foreground indication for the transport channel of the frame indicating whether the same transport channel of the different frame included the vector-based audio signal based on the indication of the type for the transport channel of the different frame.

19. The method of claim 17, wherein obtaining the foreground indication comprises obtaining, when a coding mode of a vector corresponding to the foreground audio signal indicates that the vector is a reduced vector, the foreground indication for the transport channel of the frame indicating whether the same transport channel of the different frame included the vector-based audio signal based on the indication of the type for the transport channel of the different frame.

20. The method of claim 17, wherein obtaining the independent frame indication comprises obtaining the independent frame indication for the transport channel of the frame indicating whether the same transport channel of the different frame included the vector-based audio signal when a coding mode of the vector corresponding to the foreground audio signal indicates that the vector is a reduced vector.

21. The method of claim 10, wherein the method is performed by a device coupled to the one or more speakers.

22. The method of claim 21, wherein the device comprises a television, and wherein the one or more speakers comprise one or more speakers integrated within the television.

23. The method of claim 21, wherein the device comprises a receiver.

24. A non-transitory computer-readable storage medium having stored thereon instructions that, when executed, cause one or more processors to:

obtain a multi-transition indication of whether an ambient HOA coefficient is in transition during a same frame of a bitstream as a foreground audio signal is in transition; and obtain a vector that describes a spatial characteristic of a corresponding foreground audio signal based on the multi-transition indication, the vector defined in a spherical harmonic domain;

render, based on the vector, one or more speaker feeds; and output the one or more speaker feeds to one or more speakers.

25. A device for decoding a bitstream representative of higher-order ambisonic (HOA) audio data, the device comprising:

means for obtaining a multi-transition indication of whether an ambient HOA coefficient is in transition during a same frame of the bitstream as a foreground audio signal is in transition; and means for obtaining a vector that describes a spatial characteristic of a corresponding foreground audio signal based on the multi-transition indication, the vector defined in a spherical harmonic domain;

means for rendering, based on the vector, one or more loudspeaker feeds; and means for outputting the one or more speaker feeds to one or more loudspeakers.

26. A device configured to encode a bitstream representative of higher-order ambisonic (HOA) audio data, the device comprising:

one or more processors configured to:

obtain, based on audio signals captured by a microphone, the HOA audio data;

decompose at least a portion of the HOA audio data to obtain a foreground audio signal and a vector representative of a spatial component of the foreground audio signal, the vector defined in a spherical harmonic domain;

obtain a multi-transition indication of whether an ambient HOA coefficient is in transition during a same frame of the bitstream as the foreground audio signal is in transition;

obtain elements of the vector based on the multi-transition indication; and specify, in the bitstream, the obtained elements of the vector; and a memory coupled to the one or more processors, and configured to store the vector.

27. The device of claim 26, wherein the one or more processors are further configured to obtain, in response to an indication indicating that a transition has occurred with respect to one of the ambient HOA coefficients, a background indication of a number of ambient HOA coefficients that are in transition during the frame of the bitstream, and wherein the one or more processors are configured to obtain the multi-transition indication based on the background indication.

28. The device of claim 26, wherein the one or more processors are further configured to obtain, when a coding mode of the vector corresponding to the foreground audio signal indicates that the vector is a reduced vector and based on an indication of a type for a transport channel of a different frame of the bitstream, a foreground indication of whether a foreground audio signal is in transition during the frame of the bitstream, and wherein the one or more processors are configured to obtain the multi-transition indication based on the foreground indication.

29. The device of claim 26, wherein the multi-transition indication indicates whether the ambient HOA coefficient is faded-in during the same frame of the bitstream as the foreground audio signal is faded-in.

30. The device of claim 26, wherein the multi-transition indication indicates whether the ambient HOA coefficient is faded-out during the same frame of the bitstream as the foreground audio signal is faded-out.

31. The device of claim 26, further comprising the microphone configured to capture the audio signals.

32. A method of encoding a bitstream representative of higher-order ambisonic (HOA) audio data, the method comprising:

obtaining, by one or more processors and based on audio signals captured by a microphone, the HOA audio data;

decomposing, by the one or more processors, at least a portion of the HOA audio data to obtain a foreground audio signal and a vector representative of a spatial component of the foreground audio signal, the vector defined in a spherical harmonic domain;

obtaining, by the one or more processors, a multi-transition indication of whether an ambient HOA coefficient is in transition during a same frame of the bitstream as the foreground audio signal is in transition;

obtaining, by the one or more processors, elements of the vector based on the multi-transition indication; and specifying, by the one or more processors and in the bitstream, the obtained elements of the vector.

33. The method of claim 32, further comprising:

obtaining, in response to an indication indicating that a transition has occurred with respect to one of the ambient HOA coefficients, a background indication of a number of ambient HOA coefficients that are in transition during the frame of the bitstream, specifying, in the bitstream, when a coding mode of the vector corresponding to the foreground audio signal indicates that the vector is a reduced vector, and based on an indication of a type for a transport channel of a different frame of the bitstream, a foreground indication of whether a foreground audio signal is in transition during the frame of the bitstream, and wherein obtaining the multi-transition indication comprises obtaining the multi-transition indication based on the foreground indication and the background indication.

34. The method of claim 33, wherein obtaining the foreground indication comprises specifying, in the bitstream and when a coding mode of the vector corresponding to the foreground audio signal indicates that the vector is a reduced vector, the foreground indication.

35. The method of claim 33, further comprising specifying, in the frame of the bitstream, an independent frame indication of whether the frame is an independent frame that enables the frame to be decoded without reference to a different frame of the bitstream.

36. The method of claim 35, wherein obtaining the foreground indication comprises obtaining, from the bitstream, the foreground indication in response to the independent frame indication indicating that the frame is an independent frame.

37. The method of claim 35, further comprising obtaining, in response to the independent frame indication indicating that the frame is not an independent frame, an indication of a type for the transport channel of the different frame.

38. The method of claim 35, wherein obtaining the foreground indication comprises obtaining the foreground indication for the transport channel of the frame indicating whether the same transport channel of the different frame included the vector-based audio signal based on the indication of the type for the transport channel of the different frame.

39. The method of claim 38, wherein obtaining the foreground indication comprises obtaining, when a coding mode of the vector corresponding to the foreground audio signal indicates that the vector is a reduced vector, the foreground indication for the transport channel of the frame indicating whether the same transport channel of the different frame included the vector-based audio signal based on the indication of the type for the transport channel of the different frame.

40. The method of claim 38, wherein obtaining the independent frame indication comprises obtaining the independent frame indication for the transport channel of the frame indicating whether the same transport channel of the different frame included the vector-based audio signal when a coding mode of the vector corresponding to the foreground audio signal indicates that the vector is a reduced vector.

41. The method of claim 32, wherein the one or more processors are coupled to the microphone, and wherein the method further comprises capturing, with the microphone, the audio signals.

42. A non-transitory computer-readable storage medium having stored thereon instructions that, when executed, cause one or more processors to:

obtain, based on audio signals captured by a microphone, the HOA audio data;

decompose at least a portion of the HOA audio data to obtain a foreground audio signal and a vector representative of a spatial component of the foreground audio signal, the vector defined in a spherical harmonic domain;

obtain a multi-transition indication of whether an ambient HOA coefficient is in transition during a same frame of a bitstream as the foreground audio signal is in transition;

obtain elements of the vector based on the multi-transition indication; and specify, in the bitstream, the obtained elements of the vector.

43. A device for encoding a bitstream representative of higher-order ambisonic (HOA) audio data, the device comprising:

means for obtaining, based on audio signals captured by a microphone, the HOA audio data;

means for decomposing at least a portion of the HOA audio data to obtain a foreground audio signal and a vector representative of a spatial component of the foreground audio signal, the vector defined in a spherical harmonic domain;

means for obtaining a multi-transition indication of whether an ambient HOA coefficient is in transition during a same frame of the bitstream as the foreground audio signal is in transition;

means for obtaining elements of the vector based on the multi-transition indication; and means for specifying, in the bitstream, the obtained elements of the vector.

44. The device of claim 1, wherein the one or more processors are configured to reconstruct, based on the vector, the HOA audio data, and wherein the one or more processors are configured to render, based on the reconstructed HOA audio data, the one or more speaker feeds.

45. The device of claim 1, wherein the one or more processors are configured to render, based on the vector, one or more binaural audio headphone feeds, and wherein the one or more speakers comprise one or more headphone speakers.

46. The device of claim 45, wherein the device comprises headphones, the headphones including the one or more headphone speakers as one or more integrated headphone speakers.

47. The device of claim 1, wherein the device comprises an automobile, the automobile including the one or more speakers as one or more integrated speakers.

48. The device of claim 1, wherein the one or more processors are configured to render, based on the vector and the corresponding foreground audio signal, the one or more speaker feeds.

49. The method of claim 10, wherein the method further comprises reconstructing, based on the vector, the HOA audio data, and wherein rendering the one or more speaker feeds comprises rendering, based on the reconstructed HOA audio data, the one or more speaker feeds.

50. The method of claim 10, wherein rendering the one or more speaker feeds comprises rendering, based on the vector, one or more binaural audio headphone feeds, and wherein the one or more speakers comprise one or more headphone speakers.

51. The method of claim 10, wherein rendering the one or more speaker feeds comprises rendering, based on the vector and the corresponding foreground audio signal, the one or more speaker feeds.

* * * * *